US012065799B2

(12) United States Patent
Välisalo et al.

(10) Patent No.: US 12,065,799 B2
(45) Date of Patent: Aug. 20, 2024

(54) METHOD FOR FORMING A PILE WALL IN GROUND AND A CORRESPONDING PILE WALL

(71) Applicant: Pirkan Laatupalvelu Oy, Pirkkala (FI)

(72) Inventors: Juhani Välisalo, Pirkkala (FI); Risto Välisalo, Spånga (SE)

(73) Assignee: PIRKAN LAATUPALELU OY, Pirkkala (FI)

( * ) Notice: Subject to any disclaimer, the term of this patent is extended or adjusted under 35 U.S.C. 154(b) by 147 days.

(21) Appl. No.: 17/751,725

(22) Filed: May 24, 2022

(65) Prior Publication Data

US 2022/0282443 A1 Sep. 8, 2022

Related U.S. Application Data

(63) Continuation-in-part of application No. PCT/FI2022/050193, filed on Mar. 25, 2022, and a (Continued)

(30) Foreign Application Priority Data

Nov. 29, 2019 (FI) ..... 20196036
Mar. 25, 2021 (FI) ..... 20215339

(51) Int. Cl.
*E02D 5/12* (2006.01)
*E02D 5/18* (2006.01)
(Continued)

(52) U.S. Cl.
CPC ..... *E02D 5/12* (2013.01)

(58) Field of Classification Search
CPC .. E02D 5/12; E02D 5/385; E02D 5/20; E02D 15/04; E02D 19/12
See application file for complete search history.

(56) References Cited

U.S. PATENT DOCUMENTS 910,252 A * 1/1909 Wolfley ..... E02D 5/385 405/240
2,101,285 A 12/1937 Stevens
(Continued)

FOREIGN PATENT DOCUMENTS

FI 20196069 A1 5/2021
GB 2315086 A 1/1998
(Continued)

OTHER PUBLICATIONS

Finnish Search Report in corresponding Finnish Patent Application No. 20196069, dated Jul. 31, 2020, 5 pages with English Translation.

(Continued)

*Primary Examiner* — Benjamin F Fiorello
*Assistant Examiner* — Stacy N Lawson
(74) *Attorney, Agent, or Firm* — FisherBroyles, LLP; Robert Kinberg

(57) ABSTRACT

A method for forming a drilled pile wall in ground using a drilling device having a reamer and flushing with a medium to remove drilling waste during drilling, and non-rotating pipe piles equipped with interlocks. A vertical 1 hole is drilled while simultaneously placing a pipe pile in the drill hole. At least one subsequent vertical hole is drilled hole in the ground side by side with the drill hole while simultaneously placing a subsequent pipe pile in the subsequent drill hole while the interlocks of the subsequent pipe pile interlock with interlocks of the pipe pile to guide the subsequent pipe pile into the drill hole. Reinforcements are installed in the drill holes, concrete is cast into each pipe pile to form a concrete pile, and at least some of the pipe piles are lifted at least partly out of the drill hole after the concrete has been cast, but before the concrete has bonded rigid to form a (Continued)

unified watertight pile wall. The invention also relates to a pile wall.

17 Claims, 30 Drawing Sheets

Related U.S. Application Data continuation-in-part of application No. PCT/FI2020/050803, filed on Nov. 27, 2020.

(51) Int. Cl.
*E02D 5/34* (2006.01)
*E02D 5/38* (2006.01)

(56) References Cited

U.S. PATENT DOCUMENTS

| | | | | |
|---|---|---|---|---|
| 3,420,067 | A | 1/1969 | Bjerking | |
| 3,499,293 | A | 3/1970 | Kato | |
| 3,823,562 | A * | 7/1974 | Bacmanak | E02D 5/18 405/267 |
| 3,969,902 | A | 7/1976 | Ichise et al. | |
| 2011/0142550 | A1 | 6/2011 | Lee | |

FOREIGN PATENT DOCUMENTS

| | | | | |
|---|---|---|---|---|
| KR | 20090051727 | A | 5/2009 | |
| KR | 20110136258 | A | 12/2011 | |
| KR | 2017035741 | A * | 3/2017 | E02D 17/04 |
| KR | 101846455 | B1 | 4/2018 | |
| WO | 9102850 | A1 | 3/1991 | |
| WO | 2009103149 | A1 | 8/2009 | |
| WO | 2010032485 | A1 | 3/2010 | |
| WO | 2010105258 | A1 | 9/2010 | |
| WO | 2017063021 | A1 | 4/2017 | |
| WO | 2019017498 | A1 | 1/2019 | |
| WO | 2021105569 | A1 | 6/2021 | |

OTHER PUBLICATIONS

Finnish Search Report in corresponding Finnish Patent Application No. 20215339, dated Nov. 3, 2021, 3 pages with English Translation.

International Search Report in corresponding International Patent Application No. PCT/FI2020/050803, mailed Mar. 24, 2021, 4 pages.

* cited by examiner

METHOD FOR FORMING A PILE WALL IN GROUND AND A CORRESPONDING PILE WALL

CROSS-REFERENCE TO RELATED APPLICATIONS

The present application is a Continuation-in-part of International Patent Application No. PCT/FI2020/050803, filed in Nov. 27, 2020, which claims benefit of Finnish Patent Application No. 20196036 filed in Nov. 29, 2019, and of International Patent Application No. PCT/FI2022/050193, filed in Mar. 25, 2022, which claims benefit of Finnish Patent Application No. 20215339 filed in Mar. 25, 2021.

FIELD OF THE INVENTION

The invention relates to a method for forming a pile wall in ground. The invention also relates to a corresponding pile wall.

BACKGROUND OF THE INVENTION

A pipe pile wall is a watertight retaining-wall structure used generally in soft subsoil or often also in non-cohesive soil. Pipe pile walls are often built from pipe piles drilled or driven into the ground, which include steel interlocks to join them together to form an abutment-wall structure. The lower ends of the individual pipe piles are usually supported by drilling them into rock. Interlocking pipe pile walls and/or Combiwalls are made, for example, by SSAB, whose pipe piles, known under the product names RD RM/RF or with an E21 interlock, are suitable for building pipe pile walls. When the wall structure is made, SSAB's round pipe piles are drilled into the ground, cast full of concrete, and finally compacted, for example along the RF interlock channel. The problem with such a structure is its expensive construction, as the square-metre cost of pipe piles to the width of the finished wall structure is several hundred euros, and sometimes even more than a thousand euros.

SUMMARY OF THE INVENTION

An object according to the invention is to create a cheaper method than those of the prior art for forming a pipe pile wall in ground.

The above and other objects are achieved according to one aspect of the invention wherein there is provided a method for forming a pile wall in ground, wherein according to one embodiment, the method includes drilling a plurality of parallel, essentially vertical drill holes using a drilling device, moving a non-rotating pipe pile, equipped with longitudinal interlocking, into each hole after the drilling device, which parallel pipe piles are joined together with the aid of the interlocking, and are smaller in diameter than the drill hole, installing reinforcements in the drill holes to reinforce the wall structure, casting concrete in each pipe pile and lifting at least some of the parallel pipe piles at least partly out of the drill holes after the concrete has been cast but before the concrete has transitioned from a fluid concrete paste to rigid concrete to expand the concrete laterally into adjacent drill holes to form a unified watertight pile wall with the concrete piles of the adjacent drill holes.

Advantages of the method according to the invention are excellent economy and a good result in the case of the pile wall. By lifting at least some of the pipe piles at least partly out of the drill holes and using them, or at least some of them, again, the same pipe piles can be used as formwork several times over and a large materials cost arising from the pipe piles will be saved in making the pile wall. Instead of the pipe piles, the price of the reinforcement left in the pile wall is only a fraction of the cost of the pipe piles. On the other hand, by means of the method according to the invention an extremely strong and advantageously watertight pile wall is achieved, which can also be easily made even in hard ground, unlike in situ piles. Piling using pipe piles is also cheaper in soft ground than drilling an in situ pile or using in situ piles to build a so-called "Secant" in situ pile wall. By means of the method according to the invention, the interlocks used in the pipe piles ensure the correct distance of the holes in drilling to a depth of even 50 m, in which it would be extremely difficult, if not impossible to align drilled pipe piles without interlocks precisely enough to achieve a watertight and continuous pile wall.

Using the method according to the invention it is not necessary to drill down to the bedrock, as the concrete pile remaining in the pile wall locks through its outer surface directly to the ground and does not slip downwards by gravity. Pile walls according to the prior art must always be drilled down to bedrock, as the slippery outer surface of the pipe pile remaining in the pile wall causes the pipe pile to creep downwards by gravity, unless the pipe pile is supported from beneath by the bedrock.

In other words, in the method a pipe pile is used as temporary formwork in the manner of in situ piles. Thus, with the aid of pipe piles a reliable and strong formwork is easily formed for the pile wall being cast and advantageously permits the formation of a watertight pile wall even beneath the surface of the groundwater, where it would be impossible to cast concrete without formwork. On the other hand, the method according to the invention is considerably simpler than the use of in situ piles, in which there are considerably more method stages in making an individual in situ pile.

In the method the pipe piles are preferably drilled down to non-cohesive soil. Non-cohesive soil locks the structure in place by its lower end, so that movements in the topsoil layers are not able to move the structure horizontally.

Alternatively in the method the pipe piles are drilled down to bedrock. The bedrock too locks the lower edge of the structure firmly in place, provided bedrock can be found at the drilling site.

According to one embodiment, the pipe piles are drilled down to a layer of stable ground. This ensures that the lower ends of the pipe piles cannot move horizontally.

According to one embodiment, the pipe piles are only drilled down to the surface of the bedrock, and after the lifting of the pipe piles and hardening of the concrete pile a locking hole is drilled into the bedrock through a reserve hole, in which a rock bolt is installed to lock the wall structure to the bedrock. Such an implementation is a very economical way to create a foundation for the wall structure in ground with bedrock, in which drilling a hole is expensive and laborious.

According to one embodiment, it is possible in the method to drill the adjacent drill holes in such a way that the cross-sections of the adjacent drill holes intersect each other at least at one point, thus permitting the interlocks of the pipe piles to attach to each other. At the same time, the adjacent drill holes fill with concrete to join the concrete piles to each other, thus advantageously forming a watertight structure. Alternatively, the drill holes can also touch each other, without intersecting each other, but then the thin soil layer remaining between the drill holes is broken with the aid of the interlock by pushing when installing the pipe pile.

The drill hole's diameter can be 200-2000 mm, preferably 600-1200 mm With such a drill hole diameter a sufficient number of reinforcements can be fitted into the drill hole to make the structure sufficiently strong against the forces acting on it.

The pipe pile is preferably moved by pulling or pushing after the drilling device, with the aid of a transfer shoulder. Thus, the pipe pile can be placed in the hole without rotation.

Advantageously, in the method the pipe piles may be flushed using water as the medium leading the drilling waste upwards outside the pipe pile. Water flushing causes very little loading on the soil outside the drill hole. In addition, the interior of the pipe pile remains clean.

Alternatively, in the method the pipe piles are flushed using water as the medium, leading the drilling waste up inside the pipe pile. Water flushing causes very little loading on the soil outside the drill hole.

Further, alternatively in the method the pipe piles are flushed using air as the medium, leading the drilling waste upwards inside the pipe pile.

In the method, brackets are preferably welded to the end of each drilled pipe pile going first into the drill hole, before the pipe pile is drilled into the ground, which brackets are welded on the side of the drilled pipe pile next to the already drilled drill hole, each on one side relative to the intersection with the adjacent drill hole, to support the pipe pile in the drill hole with the aid of the bracket, to hold the pipe pile straight during drilling. When drilling a drill hole next to an existing drill hole, a sector of the reamer of the drilling device can rotate in the already existing drill hole, so that at that point there is no resistance to its progression. On the other hand, most of the reamer runs against the ground, which resists the progression of the bit. As a result, the pipe pile being pulled behind the drilling device can turn towards the adjacent drill hole, particularly when it is drilling in rock. With the aid of the brackets, the pipe pile is now supported in the unbroken ground, for example in rock, so that the pipe pile cannot tilt towards the adjacent drill hole, but instead progresses in a straight line.

According to a first embodiment, the interlocks of each drilled pipe pile include a male interlocking member and female interlocking member, or both, of which the female interlocking member is dimensioned to be relatively loose relative to the male interlocking member, leaving an open space in the female interlocking member for the injection of a medium. In the method, concrete is injected through the female interlocking member at the same time as each pipe pile is lifted out of the drill hole preferably by vibration, thus ensuring that the concrete piles in adjacent drill holes join to each other, after the lifting of the pipe piles, to form a uniform watertight pile wall. In this way, the water-tightness of the pile wall can be ensured by injecting concrete where the pile wall would otherwise be weakest. The connective surface area of the adjacent drilled pipe piles can be as small as possible and thus the effective dimension of the pile wall are great as possible, as the tightness of the joints of the concrete piles can be ensured with the aid of injection.

According to a second embodiment, in the method an injection hose is connected to the outer surface of each pipe pile, using locking means to lock the injection hose to the bottom of the drill hole, thus exploiting the mass of the concrete coming on top of the locking means, and injecting compaction mass into the drill hole after lifting the drilled pipe pile, to ensure the tightness of the pile wall. In such a way the tightness of the pile wall can also be ensured, but by using a separate injection hose, which is less likely than the female interlocking members to become blocked.

Alternatively, in the method at least one hollow reinforcement, in which there is a reserve pipe, is installed in the reinforcements, and is left empty during the concrete casting. The reserve pipe permits, for example, the injection of a sealing mass to improve the tightness of the pile wall or continued drilling through the reserve pipe.

The reinforcements are set inside the pipe piles, preferably before the casting of the concrete, when they are easy to install.

The reinforcements are preferably fitted inside each pipe pile. An extremely strong pile wall is then achieved.

Alternatively, the reinforcements can be vibrated into the pipe piles when the concrete already cast. Such an operating procedure can require special arrangements, due to the pushing of the reinforcements.

The reinforcements are preferably steel reinforcements. With the aid of the steel reinforcements plenty of strength is obtained in the concrete pile, at quite low cost.

Alternatively, the reinforcements can be, for example, composite reinforcements, fibre-composite reinforcements, fibre reinforcements, or other reinforcements suitable for the purpose.

In the method, a transverse support structure can be installed between the concrete piles after the lifting of the pipe piles, to reinforce the pile wall by vibration.

According to one embodiment, vibration can be used to spread into transverse reinforcements the reinforcements installed at a slant inside the pipe pile.

According to one embodiment, in the method a guide support, preferably an H beam, can be set inside two pipe piles in connection with reinforcement, and after the lifting of the pipe piles a support plate, which is supported on the guiding of each concrete pile, is set between the concrete piles. Such a structure can also be used to increase the tightness and sturdiness of the pile wall.

Alternatively, the transverse support structure can also be, for example, transversely placed reinforcement steel, which is placed between the vertical reinforcements in the pile wall.

According to one embodiment, in the method slanting reinforcements are used, which are placed at an angle of 45-70° relative to the longitudinal direction of the pipe piles in the longitudinal direction of the pile wall, before casting the concrete, which slanting reinforcements lie partly on the web between the pile wall's pipe piles, due to the pressure caused by the concrete casting and preferably also to the effect of the vibration. Thus, the part of the pile wall between the concrete piles is reinforced.

According to one embodiment, the thickness of the ribbed reinforcement used as reinforcement can be 10-25 mm, preferably 12-18 mm. This will give the structure sufficient strength.

Preferably all the pipe piles are cast full of concrete before they are lifted. Thus, the concrete of adjacent pipe piles can spread into each other before the concrete sets, i.e., the cement paste stiffens into a state in which the paste changes from fluid to rigid.

According to one embodiment, the reinforcements include vertical reinforcements and spring reinforcements connecting to the vertical straight reinforcements, which are arranged to compress inside the pipe pile and to spread in essentially the transverse direction of the pipe piles and in the pile wall's longitudinal direction, when lifting the pipe pile to reinforce the pile wall. Such a construction ensures that there are also reinforcements in the pile wall between the vertical straight reinforcements, where reinforcement cannot otherwise be placed in connection with the installation of the pipe piles.

All the pipe piles are preferably lifted out of the drill holes. The consumption of pipe piles is then minimized Preferably the pipe piles are lifted completely out of the drill holes, so that they can be reused.

Alternatively, the pipe piles are lifted at least partly out of the drill holes. The pipe piles can, however, be left for that distance inside the drill hole for which a concrete pile could not be used without a protective pipe pile, for example, in an area of flowing seawater, in which, after lifting the pipe pile the seawater would prevent the concrete pile from hardening and drying and would destroy the structure without a pipe pile. The pipe pile is preferably then lifted out of the drill hole by enough that the pipe pile still extends to a layer of stable ground. When lifting only part of the pipe pile from the drill hole it is preferable that the part of the pipe pile lifted from the drill hole is cut away and can be reused. On the other hand, at least part of the pipe pile can be partly lifted out, part of the pipe pile can also remain as part of pile wall.

The pipe piles are preferably lifted out by vibrating, resulting in the compaction of the concrete in the concrete piles. This is the most cost-effective and easy way to lift the pipe piles out of the drill holes, while at the same time the vibration makes the compaction of the concrete more effective.

The frequency of the vibration during the raising of the drilled pipe piles can be 33-45 Hz. At such a frequency the vibration is best for the compaction of the concrete and creates a watertight concrete pile when the concrete hardens. If the frequency is reduced, the wavelength acting on the ground increases and also the force, i.e., the vibration of the concrete can be performed at the desired force to achieve the best result and penetration of the concrete.

Alternatively, the pipe piles can be lifted out using a great force without vibration, if on the pipe piles' inner surfaces an integrated or separate friction reducing material layer is used between the concrete and the pipe pile.

According to one embodiment, in the method, a liquid lubricant is preferably fed into the drill hole, outside the pipe pile, between the drill hole and the pipe pile, to reduce friction between the drill hole and the pipe pile. Water or some other liquid lubricant will reduce the friction between the pipe pile and the drill hole during lifting and thus help the pipe piles to be lifted out of the drill hole. Particularly when drilling in limestone or volcanic rock the rock itself is ground finely and, when reacting with moisture, seeks to harden like concrete on the surface of the pipe pile, hindering drilling and the lifting of the pipe piles. The feed of a liquid lubricant has particular significance at such sites.

The liquid lubricant is preferably water but can also be a mixture of water and polymer, or, for example, bentonite. Water is naturally the cheapest alternative.

The liquid lubricant can be fed to the drill hole through a separate channel attached to the outer surface of the pipe pile, or through the pipe pile's female interlocking member. The use of a separate channel is possible because the drilled pipe pile's diameter is less than the drill hole's diameter and thus space remains between the pipe pile and the drill hole for a separate channel.

The pipe piles can also be lifted hydraulically with the aid of a cylinder. This is a known functioning way to lift drilling devices.

The pipe piles are preferably raised in the order of concreting. The concrete cannot then bond to the pipe piles that were concreted first before the lifting of the pipe piles, which facilitates the lifting of the pipe piles.

In this context, the term lifting refers to raising a pipe pile by at least 0.5 m or more out of the drill hole, and not, for example, the possible upwards and downwards movement caused by impact drilling.

According to one embodiment, after the lifting of the pipe piles and the hardening of the concrete pile, sealing agent is fed through to the said reserve pipe to ensure tightness. Thus, it can be ensured that fractures or other similar non-tight points do not remain in the hardened concrete pile.

In this context, the hardening of the concrete refers to the hardening of the concrete to at least 60% of its final strength.

According to one embodiment, in the method at least one plough protrusion is welded next to the interlock to the end of each pipe pile that goes into the drill hole first before the pipe pile is drilled into the ground, which plough protrusion is for a continuous sector's distance on the pipe pile's outer circumference and protrudes from the pipe pile at least as much as the reamer used in the drilling device, which plough protrusion displaces the soil when lifting the pipe pile to boost the connection of the concrete piles. The plough protrusion thus 'ploughs' the soil to the side from in front, thus expanding the connection between two adjacent drill holes and permitting the effective spreading of the concrete from one drill hole to the other thus joining the adjacent concrete piles to each other effectively. At the same time, the plough protrusion can create a vacuum behind it surrounding the concrete and filling when lifting and vibrating the pipe pile. The vacuum in turn sucks the concrete effectively between the drill holes, thus joining the concrete piles.

According to one embodiment, there are two plough protrusions, one attached to each side of the interlock, or nearly attached to the interlock in question.

According to one embodiment, in the method according to the invention pipe piles are used, in which plough protrusions are attached on each side of each interlock.

According to one embodiment, the plough protrusions are structures welded from steel plate, which have two ends, of which the first end is attached or nearly attached to the interlock and the other end is farther from the interlock, of which the first end is farther from that end of the pipe pile which attaches to the end of the drilling device, and the other end is closer to the relevant end of the pipe pile. In other words, the plough protrusions form a wedge-like plough shape in the direction of the lifting of the pipe pile. The plough-like plough protrusion causes less resistance against the soil when lifting the pipe pile.

Alternatively, the plough protrusion can also be, for example, a casing structure.

According to one embodiment, an intermediate interlock formed of two female interlocks between the pipe piles can be used to join the pipe piles to each other, in which the pipe piles only include male interlocks. Each pipe pile can then be symmetrical.

Preferably each pipe pile includes interlocks, of which one is a long interlock extending outside the diameter of the drilling device's reamer to the adjacent pipe pile's interlock in the adjacent drill hole, and the other is a short interlock, to which the adjacent pipe pile's long interlock attaches.

The pile wall can be formed of 2-100, preferably 5-50 pipe piles in a casting sequence before the pipe piles are lifted. In this way a pile wall of maximum length can be made before the pipe piles must be lifted before the concrete bonds.

Preferably the length of the interlocks of the pipe piles used to form the pile wall is 3-50% of the diameter of a pipe pile. The web between the pipe piles will then not remain so long that it would weaken the totality of the pile wall.

Preferably the drill hole's diameter is 100-120% of the total diameter of the pipe pile and the associated interlock. Thus, the pipe pile settles firmly in the drill hole and the concrete placed inside the drill hole fills the drill hole after the lifting of the pipe pile.

According to one embodiment, a retardant is used in the casting of at least some of the concrete piles, to slow the bonding of the concrete. Thanks to the use of the retardant, longer casting sequences can be made at one time in the pile wall. On the other hand, retardant can be used, for example, in the last of the pipe piles of the casting sequence, which can be left not lifted before the commencement of the next casting sequence to be joined to the pipe piles of the previous casting sequence. Thus, the part of the pile wall formed during the casting sequences can reliably joined to each other.

The consistency of the concrete used can be S2 or S3 according to standard BY50, so that it can be easily pumped and permits the embedding of possible reinforcements after the concrete casting. On the other hand, the concrete is sufficiently consistent that the raising of the pipe piles takes place without problems.

In the method, a transverse support beam can be formed in the exposed pile wall on the side of the pile wall being constructed. Thus, for example, with the aid of the support beam, a structure can be attached to the pile wall and through it to the ground.

The pile wall can be anchored to a stable ground layer on the opposite side of the pile wall relative to the transverse support beam. With the aid of anchoring, the stable structure of the pile wall can be ensured in all situations by ways known from the prior art.

According to an embodiment wherein the pile wall extends in contact with a body of water in a form of a harbour structure, at least a part of the pipe piles is raised at least partially out of the drill hole by at least part of a length of the drill hole in an area of the ground of a floor of the body of water after casting of the concrete but before the concrete sets whereby the fluid concrete paste becomes rigid, and the pipe piles remain as a part of the pile wall above the ground of the body of water. The advantages of this embodiment are its excellent economic efficiency and good final result in terms of the wall structure. The raised drill piles remain so as to form a durable and tight structure against the water of the body of water on the side above the ground. Moreover, the drill piles serve as a structure in which attachments for additional structures can be readily provided. The cost of the reinforcements left in the wall structure is only a fraction of the cost of the drill piles. Moreover, the method according to the embodiment provides a very strong and advantageously watertight wall structure that is easy to construct even in hard ground unlike excavation piles.

The length of the drill pile that remains in the wall structure is preferably 3-15 m. The pile wall structure can thereby be employed in most bodies of water.

Preferably, the pipe piles are raised by at least 1 m in order to allow the concrete to spread and at most by a length such that the pipe pile remains in the ground in the drill hole so as to protect the concrete pile from the open water. A minimum lift of 1 m ensures that a sufficiently large contact surface area is created in the pile wall between the concrete piles and the ground in order to ensure a reliable fixation of the pile wall.

Preferably a part of each raised pipe pile that extends beyond the concrete pile is cut off. By reusing the cut-off parts of the pipe piles, it is possible to save on material costs in the construction of the wall structure.

Preferably the part to be cut off is 0-10 m in length. The cut off part can be used in another drilling thus generating material costs.

The object of another embodiment is also to provide a better method for creating a pile wall for use in a sensitive area such as an aquifer. This embodiment is characterized by that the pipe pile is installed in a sensitive area using compressed air inside the pipe pile for flushing up the drilled material mainly inside the pipe pile and during drilling with compressed air water is simultaneously pumped to the drill hole in the area of a lower end of the pipe pile through a channel located outside the pipe pile to limit dropping of groundwater levels in the drill hole. This reduces the chances of the ground near the drill hole to collapse which might damage the surrounding buildings or structures.

According to this embodiment, when drilling with compressed air, water is simultaneously pumped in the drill hole using a channel outside the pipe pile to the lower end of the pipe pile-usually above the reamer, which replaces the amount of groundwater removed from the drill hole with flushing so that the groundwater level in the drill hole and its surroundings does not drop significantly.

After the drilling of the pipe pile is completed, the drilling device is removed, reinforcement is usually installed inside the pipe pile and concrete is cast inside the pipe pile. At the same time concrete is pressed down in the drill hole through the channel located outside the pipe pile, i.e., the channel thus being an injection duct. Preferably there is a plug in the channel to inject the shear zone in the ground, etc., a bad spot. The location of this bad spot has been established earlier in soil research. The solution is suitable for a single pile or piles on a pile wall.

Another object of the invention is to create a cheaper and more easily made pile wall than those of the prior art. The invention is characterized by a pile wall comprising several parallel concrete piles connected together on a stable ground layer, which concrete piles includes reinforcement set inside at least one concrete pile, and the concrete piles an essentially circular cross-sectional shape, and in which the concrete piles form the pile wall's outer surface, and each of which concrete pile has an outer surface. Each concrete pile connects by a fully integrated concrete structure to each adjacent concrete pile by a sector of 1°-50°, preferably 5°-15°, of the concrete pile's cross-section. The concrete structure has a contact surface formed on the outer surface of both sides of the pile wall directly to a stable ground layer, and the contact surface is integrated with the stable ground layer. Such a structure is very cheap to make because the expensive pipe piles do not remain in the finished pile wall. In the pile wall according to the invention, the connection surface area of the adjacent concrete piles to each other is considerably smaller than in pile walls of the prior art and, thanks to the pipe piles utilizing interlocks, is always the same, i.e., constant. Thanks to the small connection surface area, the concrete piles' effective dimension is the pile wall is large and the pile wall can be formed with less drilling than pile walls of the prior art. Thanks to the contact surface in direct contact with the ground the pile wall need not necessarily extend to the bedrock, as the contact surface locks the pile wall to the surrounding ground, thus preventing it from slipping down.

In this context, the term integrated concrete structure refers to the concrete of the adjacent concrete piles joining to form a unified concrete structure.

In this context, the term integration of the contact surface with the stable layer refers to the fact that, when it hardens the concrete adheres directly to the stable ground layer, locking the pile wall in place in such a way that the pile wall cannot slip down, unlike a slippery pile wall formed of pipe piles.

In other words, the pile wall according to the invention is formed preferably only of adjacent concrete piles and reinforcement fitted inside at least one concrete pile. The metal pipe piles do not remain in the pile wall.

In other words, the concrete piles of the said pile wall are in direct contact with the ground. Thus, in the method there is no need for separate shield pipes, which would form the outer surface of the concrete pile, instead the concrete is firmly bound to the ground over the whole length of the concrete pile.

The stable ground layer advantageously forms the formwork of the pile wall.

The pile wall is preferably watertight. This is achieved by vibrating the lifted pipe piles, which compact the concrete to become watertight.

The concrete piles of the pile wall preferably extend only to the upper surface of the rock that forms a stable layer and the pile wall includes, in addition, a reserve pipe fitted inside a reinforcement, a locking hole drilled into the rock through the reserve pipe, and a rock bolt fitted through the reserve pipe, to lock the concrete piles to the rock horizontally. Using such a construction, the pipe piles need not be drilled into the rock, but only to the surface of the rock, after which each concrete pile is attached to the rock with the aid of the rock bolt.

Preferably the concrete piles of the pile wall are in a single row. Thus, the length of the pile wall can be maximized with a minimum number of concrete piles. This is possible due to the use of interlocking pipe piles, because then the concrete piles can be formed with sufficient precision at the correct distance from each other to form a unified and durable pile wall.

According to one embodiment, the pipe piles' interlocks include male interlocks expanding from the main shape of the pipe pile and female interlocks attached to the male interlocks by welding. Preferably the male interlocks are part of the pipe pile's internal volume. The width of the male interlock can 20-30% of the diameter of the pipe pile. Using such a pipe pile creates a very sturdy pile wall, the webs between the pipe piles being also quite thick and sturdy.

The concrete piles' diameter can be 200-2000 mm, preferably 600-1200 mm With such a diameter a sufficient number of reinforcements can be fitted to the concrete pile for the pile wall to become sufficiently strong against the forces acting on it.

The pile wall's height can be 1-50 m, preferably 5-30 m, 20-30 m, depending on the drilling equipment used.

Preferably the pile wall includes as reinforcement vertical reinforcements and slanting reinforcements, which are arranged at an angle of 45-70° to the pipe piles' longitudinal direction in the longitudinal direction of the pile wall before concrete casting, which slanting reinforcements settle partly on the webs between the pile wall's pipe piles as a result of the pressure caused by the concrete casting. Thus, a reinforced pile wall is obtained in the case of the pile wall between the concrete piles.

Preferably the pile wall includes as reinforcement vertical reinforcements and transverse reinforcements which bind the vertical reinforcements in the various concrete piles to each other to reinforce the pile wall. With the aid of the transverse reinforcements a strong pile wall is created, even if the pipe piles are removed completely.

According to one embodiment, the transverse reinforcements are spring reinforcements attached to the vertical reinforcements, which are arranged to compress on the inside of the pipe pile and the expand essentially in the transverse direction of the pipe piles and in the longitudinal direction of the pile wall, to reinforce the pile wall when the pipe piles are lifted. The spring reinforcements can be installed already when installing the other reinforcements, so that their installation does not demand a separate work stage after concrete casting.

According to a second embodiment, the transverse reinforcements are reinforcements to be spread with the aid of vibration, which are installed inside the pipe pile before concrete casting. Such transverse reinforcements need not be welded onto the vertical reinforcements, nor does their placing in the operating position demand a separate stage, if the pipe pile is raised with the aid of vibration.

According to a third embodiment, the transverse reinforcements are reinforcements embedded in the cast concrete by vibration.

The concrete of the concrete piles can be ordinary concrete, which is reinforced with various reinforcements, but alternatively it can also be macro- or steel fibre concrete, in which macro- or steel fibres form at least part of the reinforcements. Macro-fibre concrete refers to concrete, in which there are evenly distributed plastic fibres, the length of which can be, for example, 10-50 mm, depending on the type of fibre. Steel-fibre concrete refers to concrete in which there are evenly distributed steel-wire lengths, which can be, for example, 25-60 mm in length and 0.4-1.05 mm in diameter.

Preferably the pipe pile has a round cross-section in both the method according to the invention and the pile wall, when a hollow volume forms inside it for concrete and reinforcements. Thus, the pipe pile acts as temporary formwork in the method according to the invention for forming a pile wall according to the invention.

According to one embodiment, the pile wall includes a transverse support beam joined to the outer surfaces of the concrete piles on the side to be constructed of the exposed pile wall.

The pile wall can include anchors for anchoring the pile wall to a stable ground layer on the opposite side of the pile wall to the transverse support beam.

Another object of the invention is to create a cheaper and more easily made pile wall than those of the prior art that can be used in connection with a body of water. The invention is characterized by a pile wall comprising several parallel concrete piles, pipe piles covering the concrete piles partially and a substantially transverse harbour structure, wherein each concrete pile having an essentially circularly shaped cross-section, an outer surface, vertical reinforcements set inside the concrete piles and transverse reinforcements binding the vertical reinforcements in the different concrete piles to each other, the concrete piles being connected in a row at a constant distance from each other by a fully integrated concrete structure by a sector of 1°-50° of the concrete pile's cross-section at an entire length of each concrete pile to form a unified pile wall, and the pile wall having a contact surface formed on the outer surface of the concrete piles the pile wall being integrated to a stable an uncompressed layer of drilled ground, and each pipe pile having interlocks for binding the pipe piles in alignment, the interlocks comprising a long interlocking member and a short interlocking member to which the long interlocking member of the adjacent pipe pile connects, wherein at the part of the pipe wall above the ground, the pipe piles attached to each other by means of interlocks form the outer surface of the pile wall, the outer surface being in contact with a body of water, while the concrete piles respectively run continuously inside the pipe piles, and the transverse harbour structure is attached at an upper end of the pipe piles.

Preferred applications of the method and pile wall according to the invention are abutment-wall structures, building foundations, car-park buildings, harbour piers, road and railway structures, bridges, and cut-out walls for separating contaminated soil.

BRIEF DESCRIPTION OF THE DRAWINGS

In the following, the invention is described in detail with reference to the accompanying drawings showing some embodiments of the invention, in which.

DETAILED DESCRIPTION OF THE INVENTION

In the method and pile wall in the embodiments of FIGS. 1*a*-15*b* the reinforcement used is the most usual embodiment, i.e., steel reinforcement. It should be understood, however, that the embodiments shown in the figures can also be implemented correspondingly using composite reinforcement.

Figure 1A:
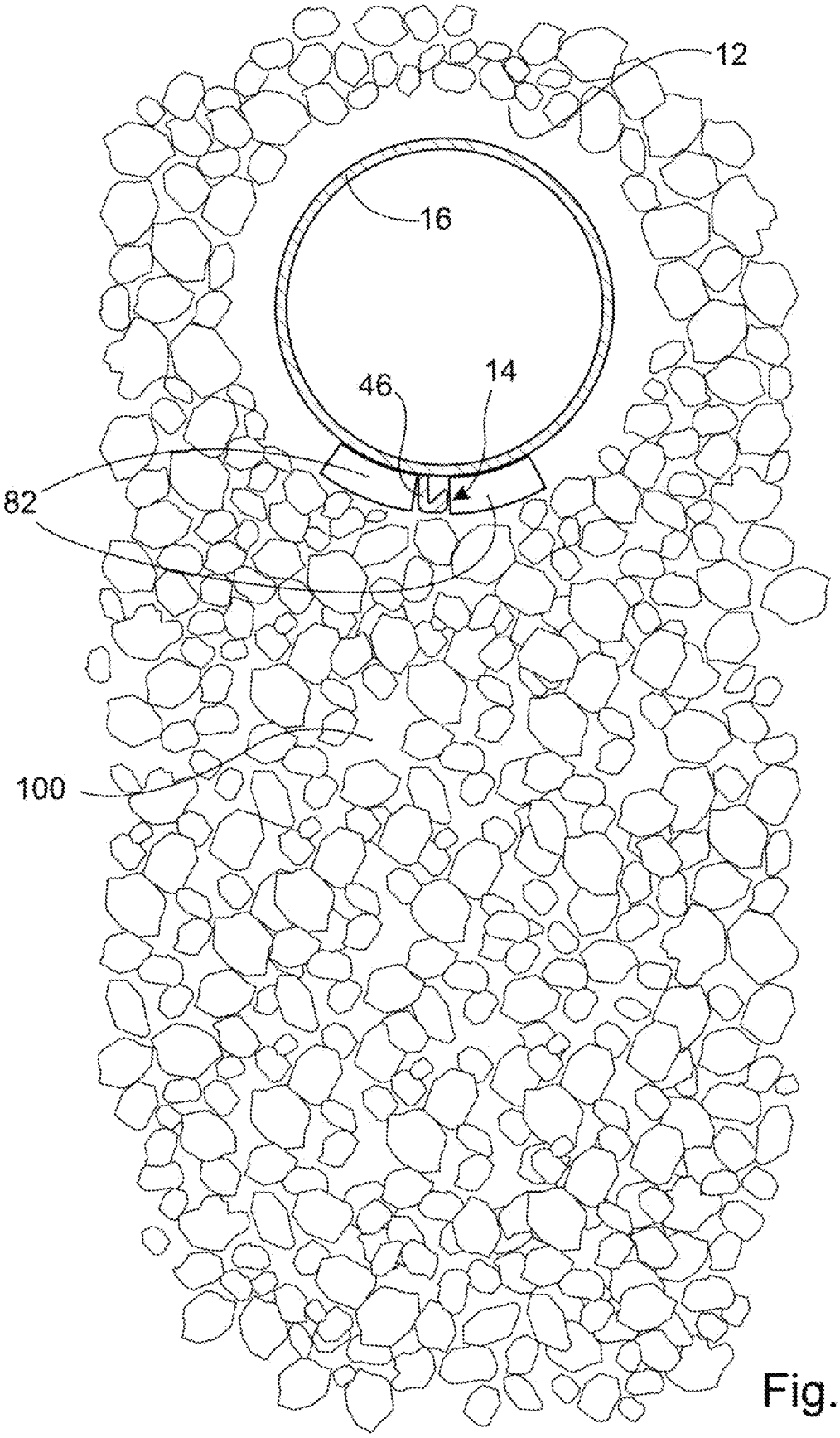
FIG. 1*a* shows the first stage of the method according to the invention, in which a drill hole is drilled in the ground and a non-rotating pipe pile is pulled after the drilling device.
Figure 4A:
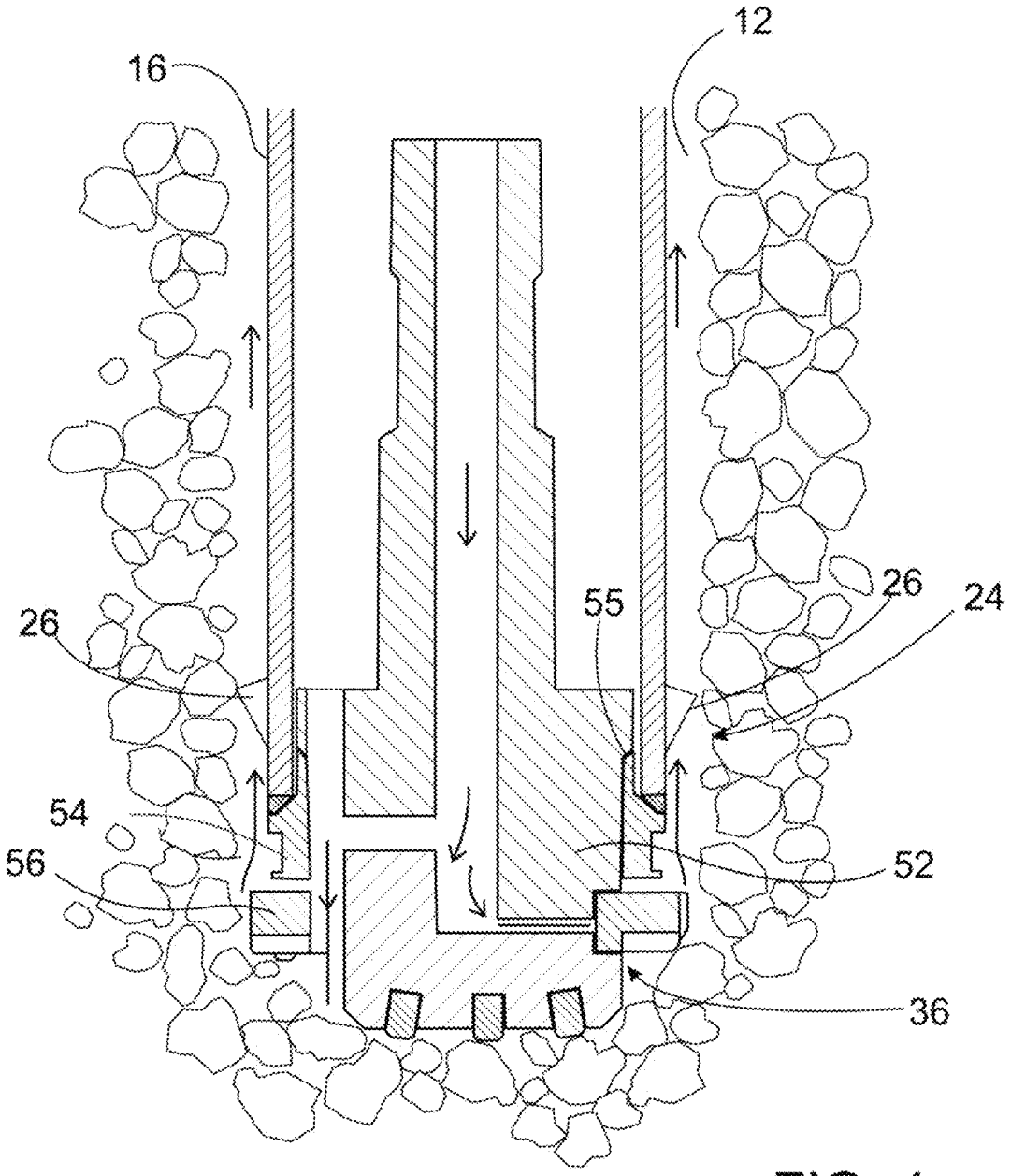
FIGS. 4*a*-4*e* show the wall structure of a pilot bit according to one embodiment of the drilling device used to drill the drilled pipe piles, and the stages of the method, in cross-section.

According to FIGS. 1*a* and 4*a*, the erection of the pile wall 10 according to the invention starts by drilling pipe piles 16 into the ground 100. As the drilling device 102, a drill using a medium for flushing can be used, which can be any device whatever intended for drilling pipe piles, with the aid of which a non-rotating pipe pile can be pulled or pushed. The medium is preferably a liquid, with the aid of which drilling waste is flushed along the outside of the pipe pile and out of the drill hole. Alternatively, the drilling waste can be flushed with the aid of a liquid or air inside the pipe pile. Preferably the drilling device is a hammer drill, but it can also be only a rotary drill.

It is important to acknowledge that drilling of the drill hole in the ground results in a different type of contact surface between the concrete pile and the ground than impact driving of pipe piles. In the method according to the invention the ground 99 shown in Figure le remains uncompressed as the rotating drill used with flushing removes soil from the drill hole and does not compact it like impact driving wherein the soil is pushed to the side by the driven pipe pile. Therefore, the ground surrounding the drilled drill hole is porous and the concrete creates a large contact surface against the porous ground. In impact driving the ground around the drill hole becomes compressed and smooth, and the contact between the concrete pile and the ground is poor, which is avoided now in the present invention.

Figure 3:
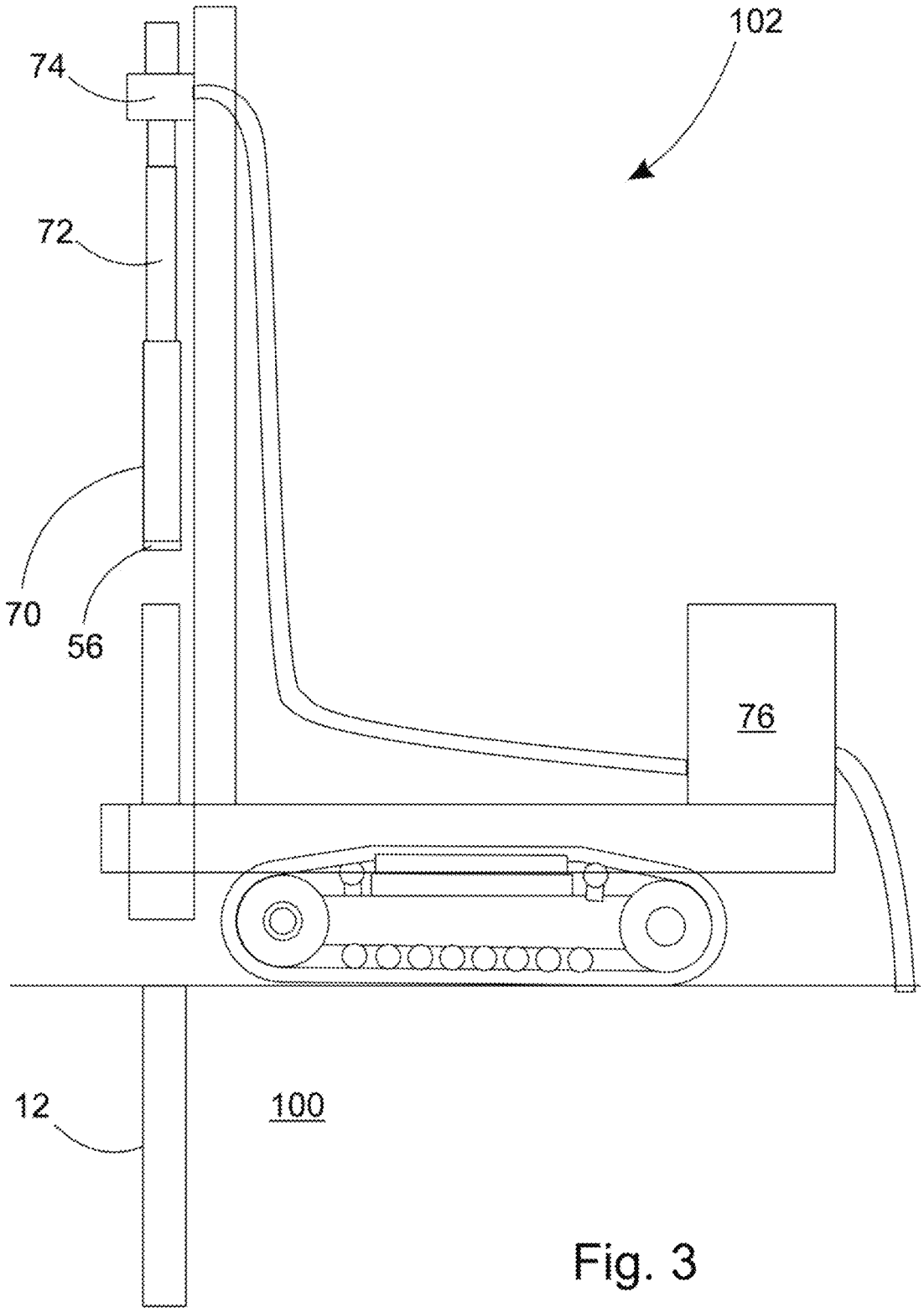
FIG. 3 shows the totality of one embodiment of the drilling device used in the method.
Figure 4B:
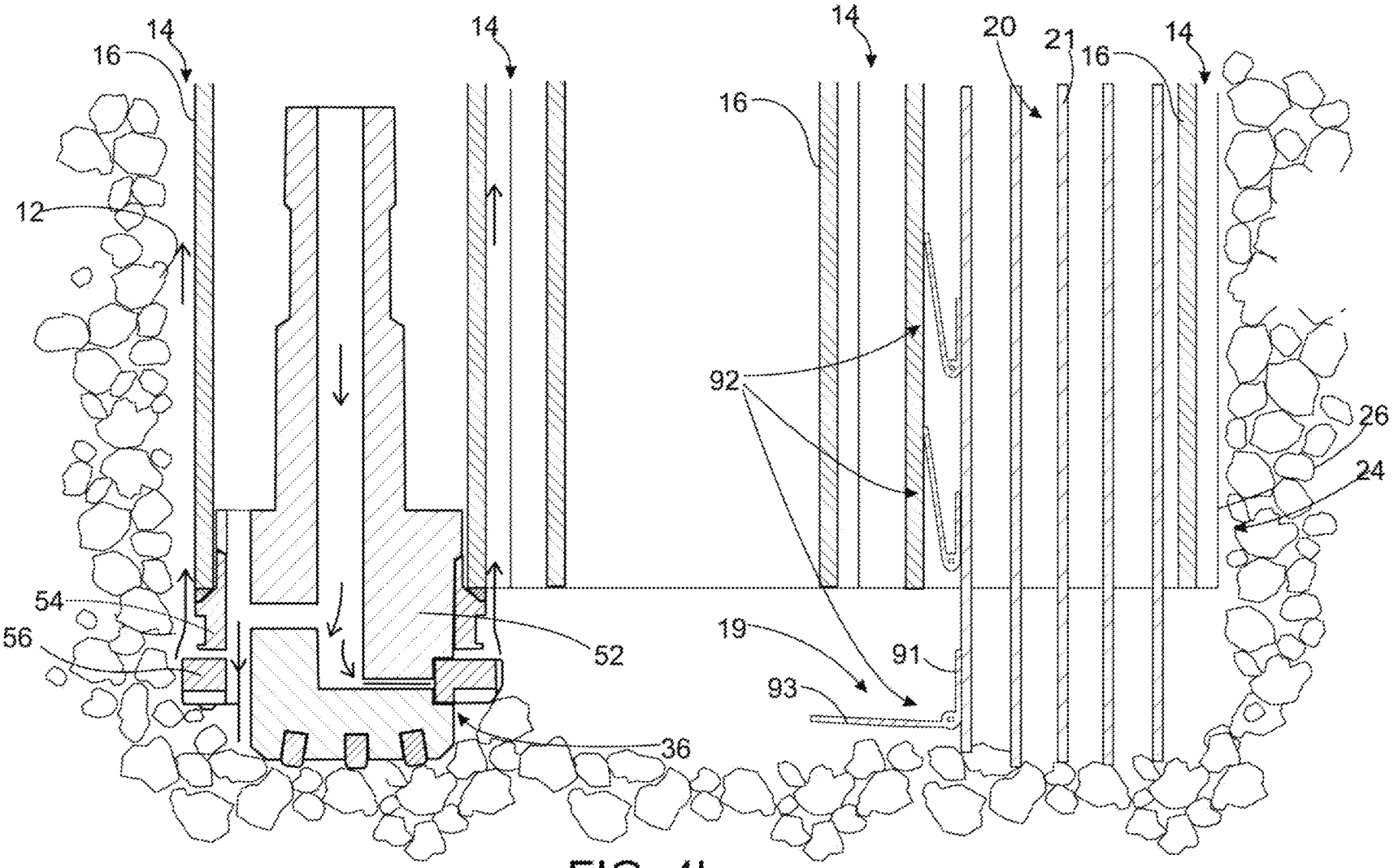

FIGS. 3, 4*a* and 4*b* show an example of a drilling device 102, which includes the following main parts: a drill bit 36, a protective cover 70, reamer 56, drill rod 72, rotating device 74, and a pressurized-medium pumping unit 76. The drilling device 102 can be, for example, a drill made by the Finnish company Epiroc Oy. The pipe pile should be such that it is able to move in the drill hole without rotating the pipe pile 16, because the pipe pile 16 includes longitudinal interlocks 14 in it, which prevent rotation of the pipe pile 16.

Preferably in the drilling device 102, the pipe pile is pulled after the pilot bit 52, the pipe pile 16 being connected non-rotatingly after the rotating pilot bit 52 with the aid of a casing shoe according to FIGS. 4*a*, 4*b*. The pipe pile 16 includes according to FIG. 4*a* a transfer shoulder 55, with the aid of which the pipe pile is, depending on the drilling device, either pulled or pushed after the drill into the drill hole. The drilling device can also include other means for pressing the pipe pile by its end into the drill hole. The drill hole 12 is expanded with the aid of a reamer 56 in addition to the pilot bit 52, so that the pipe pile 16 equipped with an interlock 14 will fit to come after the pilot bit 52 into the drill hole without damaging the interlock 14 or pushing it against the ground 100, when, for example, the female interlocking member 30 (see FIGS. 5*a*-5*c*) would be filled with soil. The reamer 56 can be, for example, a reamer bit or a ring-auger bit.

Figure 2A:
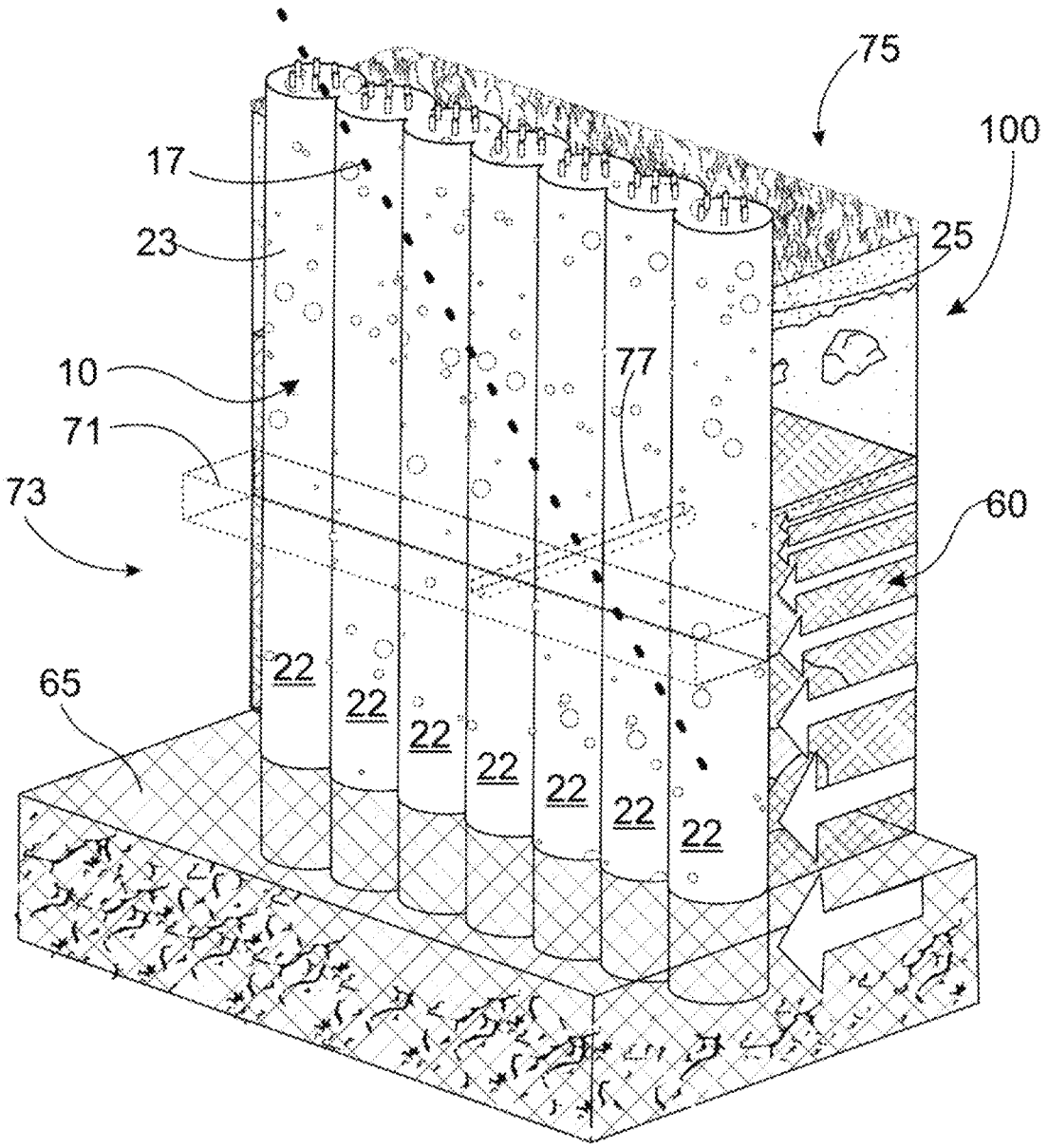
FIG. 2*a* shows an axonometric front view of the finished pile wall according to the invention, with the ground in front of wall removed.
Figure 2B:
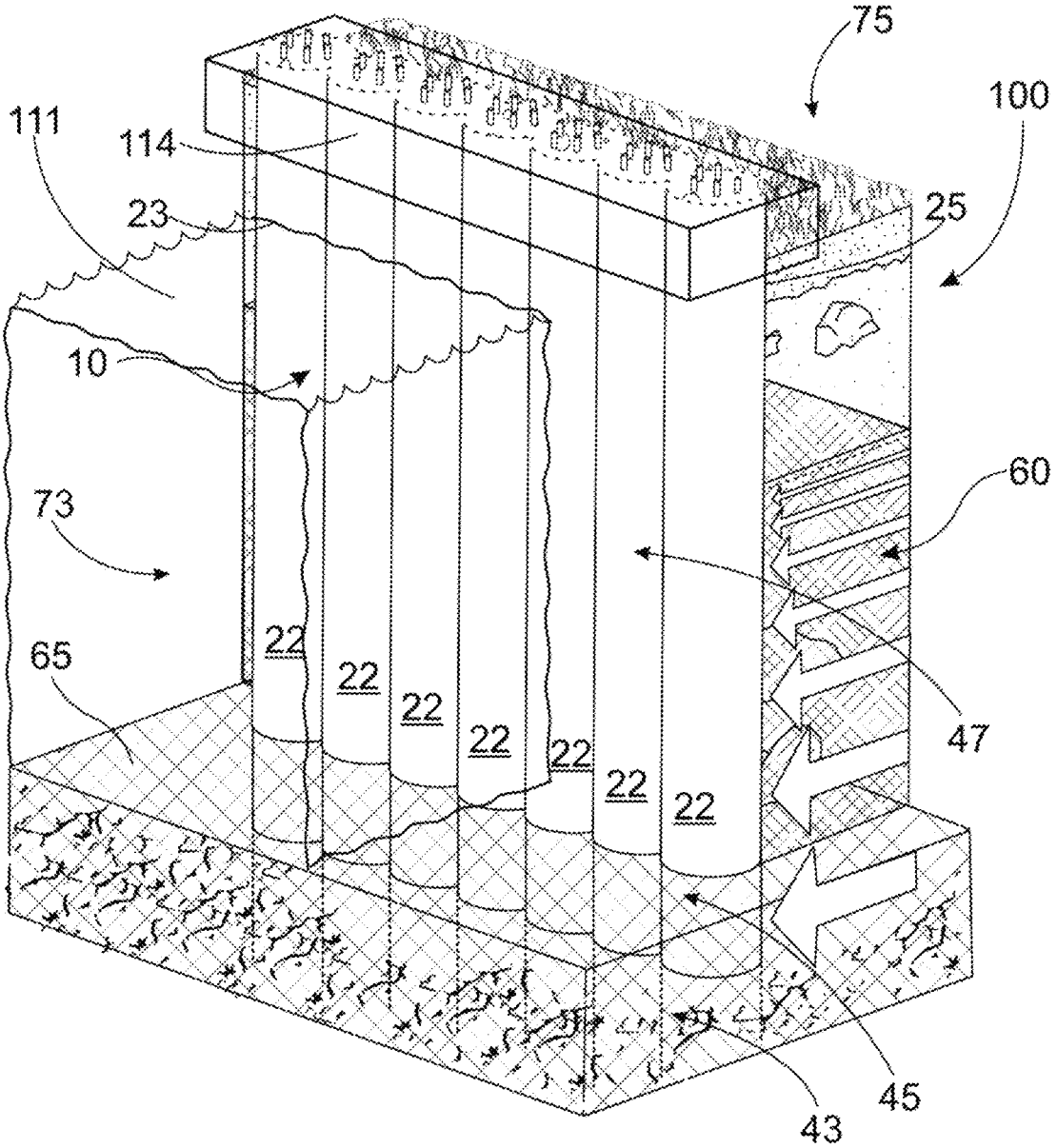
FIG. 2*b* shows an axonometric front view of the finished pile wall according to an alternative embodiment of the invention, wherein the pile wall is located in connection with a body of water.

The drill hole 12 is drilled preferably so deeply into the ground 100 that the drill hole 12 reaches a so-called stable layer in the ground 100, which remains in place and does not move horizontally. The stable layer is shown in FIGS. 2*a* and 2*b* with the reference number 60. Such as layer can be a non-cohesive soil layer or alternatively rock. A sufficient depth, to which the drill hole should preferably extend to the stable layer, is at least one metre, preferably 2-4 m. In all cases, however, this is not necessary. In connection with the drilling, the drill hole is flushed at the same time, to remove drilling waste from the drill hole. Flushing is preferably performed with the aid of a liquid along the pipe pile's outer surface and out of the drill hole, but the liquid and drilling waste can also be led inside the pipe pile. Air can also be used as an alternative to liquid in flushing. Once the drill hole 12 has been drilled to a sufficient depth, the pilot bit 52 is detached from a ground shoe 54, for example with the aid of bayonet locking, and is lifted out of the drill hole 12 while the drilled pipe pile 16 remains in the drill hole 12. Depending on the construction of the reamer 56, the reamer 56 either remains with the pipe pile in the drill hole or is lifted out of the drill hole.

Figure 1B:
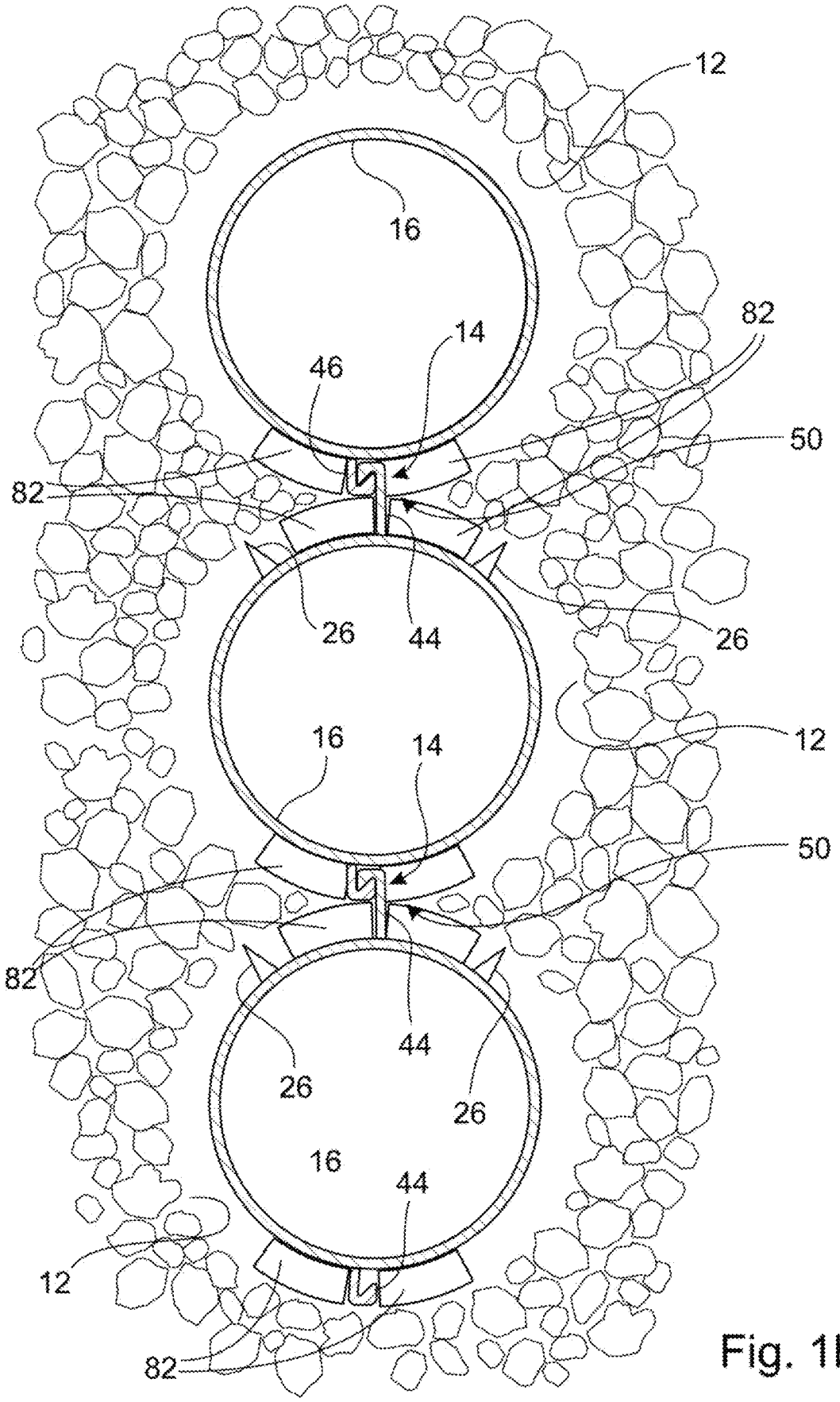
FIG. 1*b* shows the second stage of the method according to the invention, in which the pile wall is widened by drilling adjacent drill holes and installing adjacent pipe piles in the drill hole, locked to each other with the aid of interlocks.

According to FIGS. 1*b* and 4*b*, in the method according to the invention, when the pile wall 10 (shown in FIGS. 2*a*, 2*b*) is made, several adjacent drill holes 12 are formed in parallel, into each of which a pipe pile 16 is pulled after the pilot bit 52. Each new pipe pile 16 is set in the ground adjacent a pipe pile 16 already in the ground, so that the pipe piles 16 are connected to each other with the aid of interlocks 14. The interlocks 14 are aligned when pulling the new pipe pile 16, in such a way that the new pipe pile 16 slides longitudinally into the interlocks 14 of the already drilled pipe pile 16. Thus, temporary formwork for the pile wall 10 to be cast is created with the aid of the pipe piles 16 locking into each other.

Preferably the interlocks 14 of each pipe pile 16 include, according to FIGS. 1*a*-1*e*, a long interlocking member 44 and a short interlocking member 46. When drilling a new pipe pile 16 next to a previously drilled pipe pile 16, the long interlocking member 44 of the new pipe pile extends farther than the diameter of the reamer from the centre line of the pipe pile 16. The long interlocking member 44 is set in such a way that it connects to the short interlocking member of the already drilled pipe pile 16. Thus, the reamer can expand the drill hole 12 during drilling, so that adjacent drill holes 12 intersect each other at the intersection point 50, thus forming a link between the drill holes 12. Using this connection, the long interlocking member 44 travels after the reamer along the adjacent drilled pipe pile's 16 short interlocking member 46 while the reamer does not strike either interlocking member of the interlock 14. The first pipe pile can have a different structure, in that there can be only two short interlocking members, as there are no adjacent drill holes, and the interlock thus cannot extend farther from the pipe pile's centre line than the drilling device's reamer. Alternatively, there can be only one short interlock in the first pipe pile.

Figure 13:
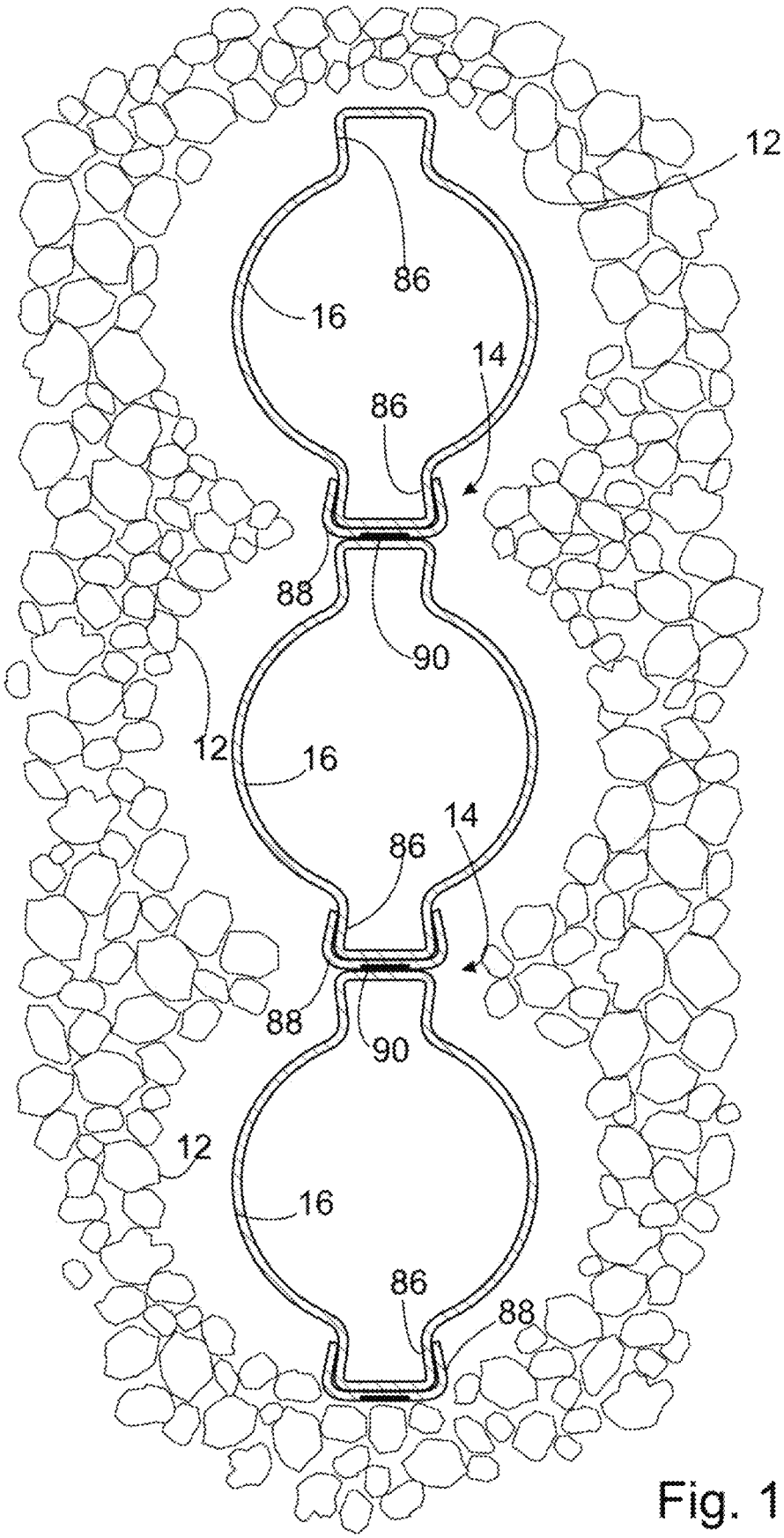
FIG. 13 shows the formation of a pile wall according to the invention using pipe piles according to a second embodiment.

Alternatively, the pipe piles' 16 interlocks 14 can be according to FIG. 13, in which the interlocks 14 include male interlocks 86 and female interlocks 88 welded to the male interlocks. According to the figure, the female interlock 88 can be attached to the pipe pile's 16 outer surface's male interlock 86 by welding 90. The advantage of such a pipe pile is the bulge in the interior of the pipe pile 16 formed by the male interlocks 86, so that the cast concrete is quite wide also on the webs 35 (FIG. 4*d*) between the main shape of the pipe pile. This leads to a sturdier pile wall.

The adjacent drill holes 12 can also be drilled in such a way that a thin soil layer remains between them, which is arranged to be broken by the pipe pile's 16 interlock 14 (not shown). The largest dimension of the ground layer depends on the ground's properties. In soft soil the interlock 14 can penetrate through even a wide ground layer and nevertheless bind the adjacent pipe piles to each other. The interlock can then too be channelled, for example, for steel reinforcement or for injection. The web 35 remaining between the main shapes of the pipe piles can even be in the order of the pipe's diameter D, i.e., the web's dimension would be 0-D, however preferably 0-D/2. Naturally, the dimension can be limited by the fact that the concrete cast into each pipe pile should join the concrete mass of the adjacent pipe pile when the pipe piles are raised.

Figure 1C:
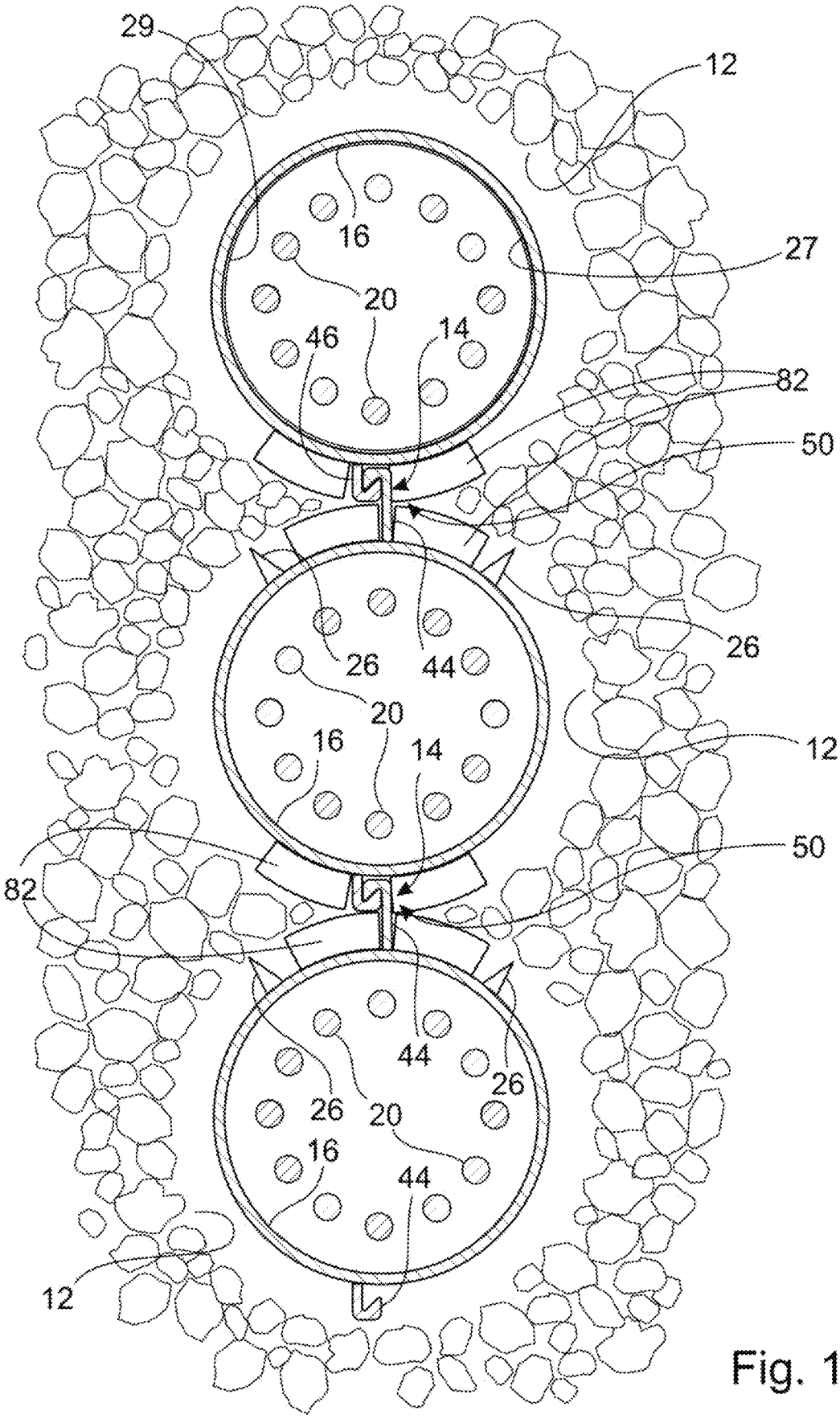
FIG. 1*c* shows the third stage of the method according to the invention, in which reinforcement is installed inside the pipe piles fitted in the drill holes.
Figure 1D:
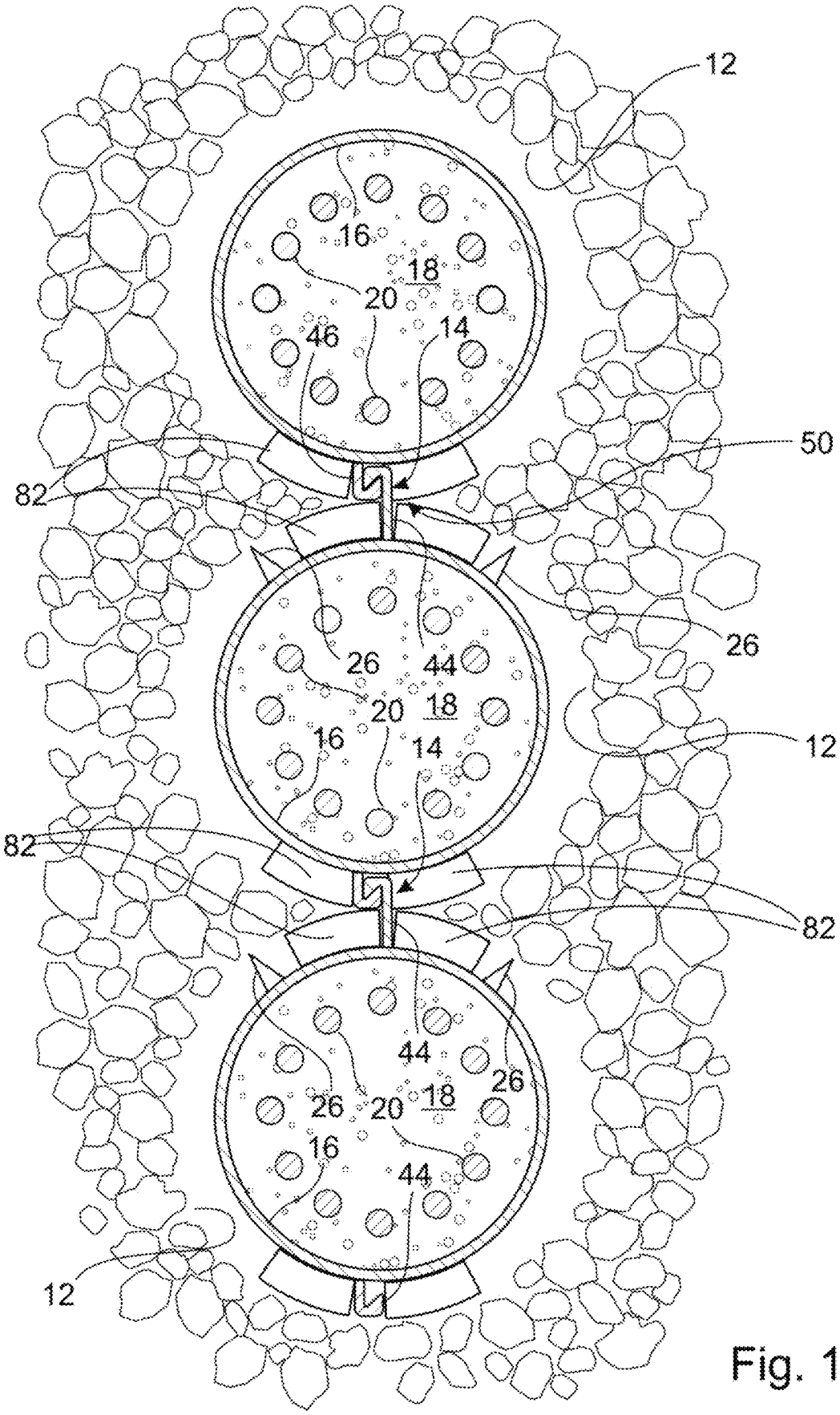
FIG. 1*d* shows the fourth stage of the method according to the invention, in which concrete is cast inside the pipe piles fitted in the drill holes.

According to FIGS. 1*b*-1*d*, the pipe piles 16 can include brackets 26, which support the pipe pile 16 against the inner surface of the drill hole 12 and thus prevent the pipe pile turning in the direction of the adjacent drill hole 12. The brackets 26 can be of such a height that they extend slightly farther radially than the reamer from the centre line of the pipe pile. If the reamer makes, for example a drill hole 54-mm larger than the diameter of the pipe pile at the brackets, the diameter can be up to 56-58-mm larger than the pipe pile's diameter. The brackets then travel against the ground and wear slightly, settling securely against the ground. The brackets 26 can have a side profile like a sharks fin according to FIG. 4*a*, when they travel smoothly in the drill hole after the drilling device. It should be understood that differing from 1*b*-1*d* the brackets may also be blunt, with, for example, a semi-circularly shaped side profile, or otherwise be suitably shaped for the purpose.

Figure 4C:
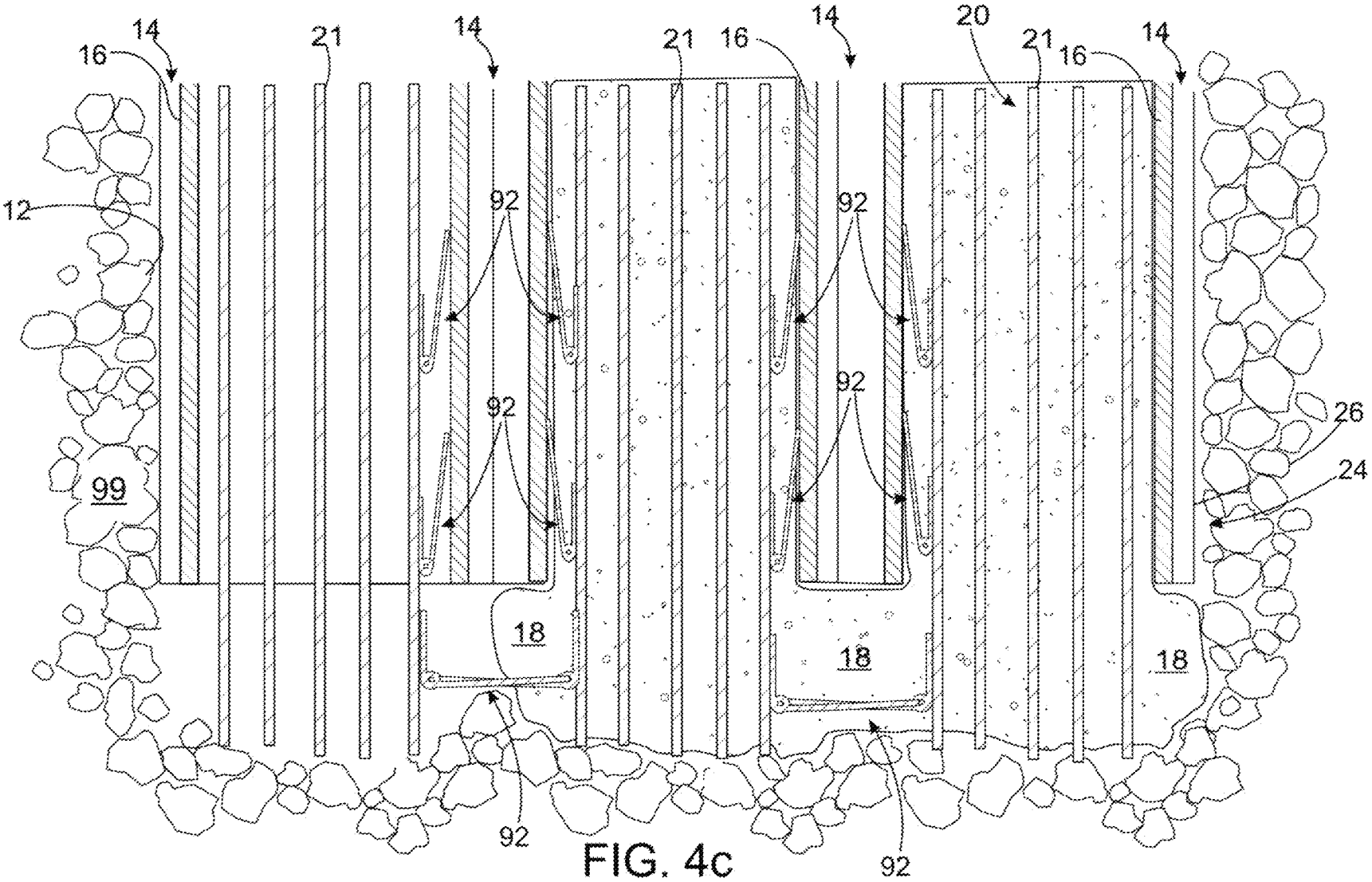

Once the desired width of the pile wall 10 being formed has been achieved by drilling into the ground 100, the desired number of pipe piles 16 being connected together by interlocks 14, the reinforcements 20 can be placed inside the pipe piles 16, according to FIGS. 1*c* and 4*c*. If resources permit, the placing of the reinforcements 20 can be started in some of the pipe piles 16 simultaneously with the drilling of the other pipe piles 16 into the ground 100 according to FIG. 4*b*. In reinforcement, ribbed bar, or some other similar reinforcing steel, is lowered inside the pipe pile 16. The reinforcement is preferably of a flat ribbed-steel mesh welded into a circular structure. The amount of reinforcement is determined by the strength required in the pile wall 10, which in turn depends on the demands of the operating environment.

Preferably after the placing of the reinforcements 20, concrete 18 is cast inside the pipe piles 16 according to FIG. 1*d*, inside which the reinforcements 20 remain. The pipe pile 16 acts as formwork for the concrete 18. The concrete 18 fills the interior of the pipe pile 16, thus forming a reinforced concrete pile 22. If necessary, a selected binder can be mixed with the concrete 18 to improve the water-tightness of the concrete 18.

Alternatively, the concrete can be cast into the pipe piles already before the installation of the reinforcements, but then the reinforcements must be vibrated to press through the freshly cast concrete.

According to FIGS. 4*b*-4*e*, in addition to the vertical straight reinforcements 21, the reinforcements 20 can also include transverse reinforcements 19 creating a slanting support. The transverse reinforcements are preferably spring reinforcements 92, which can be welded onto the vertical reinforcements 21. The spring reinforcements are an embodiment of the transverse reinforcements. The spring reinforcements 92 can include a weld part 91 and a transverse-support part 93 transverse to the concrete piles in the final pile wall, and a joint between them. In FIGS. 4*b*-4*e* the spring reinforcements 92 are torsion springs, in which the weld part 91 is welded onto the vertical reinforcements 21 and the transverse-support part 93 tensions when the reinforcements are installed inside the pipe pile 16, being released finally during the lifting of the pipe pile 16 to become transverse to the pipe piles 16, thus forming reinforcements also in the area of the pipe piles' 16 interlocks in the area between the concrete piles 22.

Figure 14A:
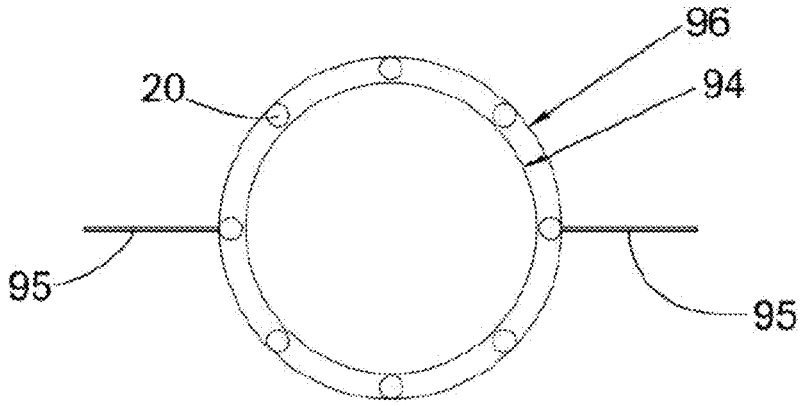
FIGS. 14*a* and 14*b* show slanting reinforcements according to another embodiment.
Figure 14B:
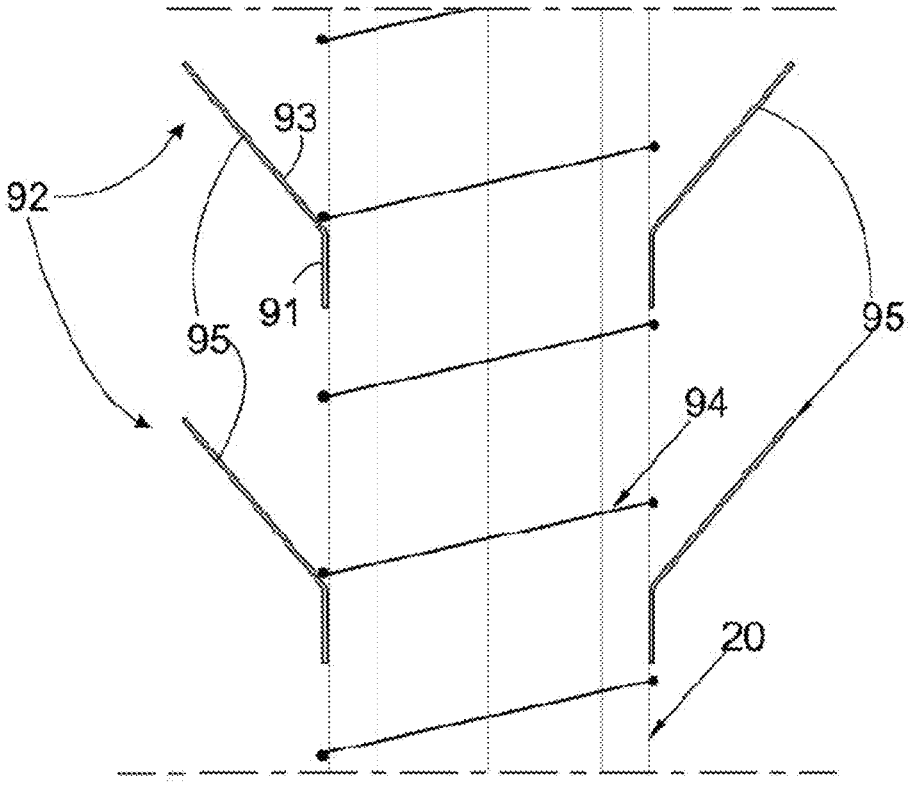

As an alternative to the torsion springs shown in FIGS. 4*b*-4*e*, it can be contemplated that the spring reinforcement 92 can also be a straight spring 95 according to FIGS. 14*a*-14*b*, which can be attached to a corral 96 surrounding the vertical reinforcements 21. Here, the vertical reinforcements 21 are also bound together with the aid of an installation band 94.

The pipe wall can be formed of 2-100, preferably 5-50 pipe piles drilled into the ground together in an essentially unbroken casting sequence, until the lifting of the pipe piles is commenced. The pipe piles are lifted before the concrete binds, in which the concrete paste changes from fluid to rigid, after which the concrete begins to harden and the lifting of a pipe pile becomes very difficult or even impossible, without breaking the structure of the concrete pile. The length of the casting sequence can be influenced by using retardants in the concrete mix, which slow the binding of the concrete and thus lengthen the time for lifting the pipe piles.

Figure 1E:
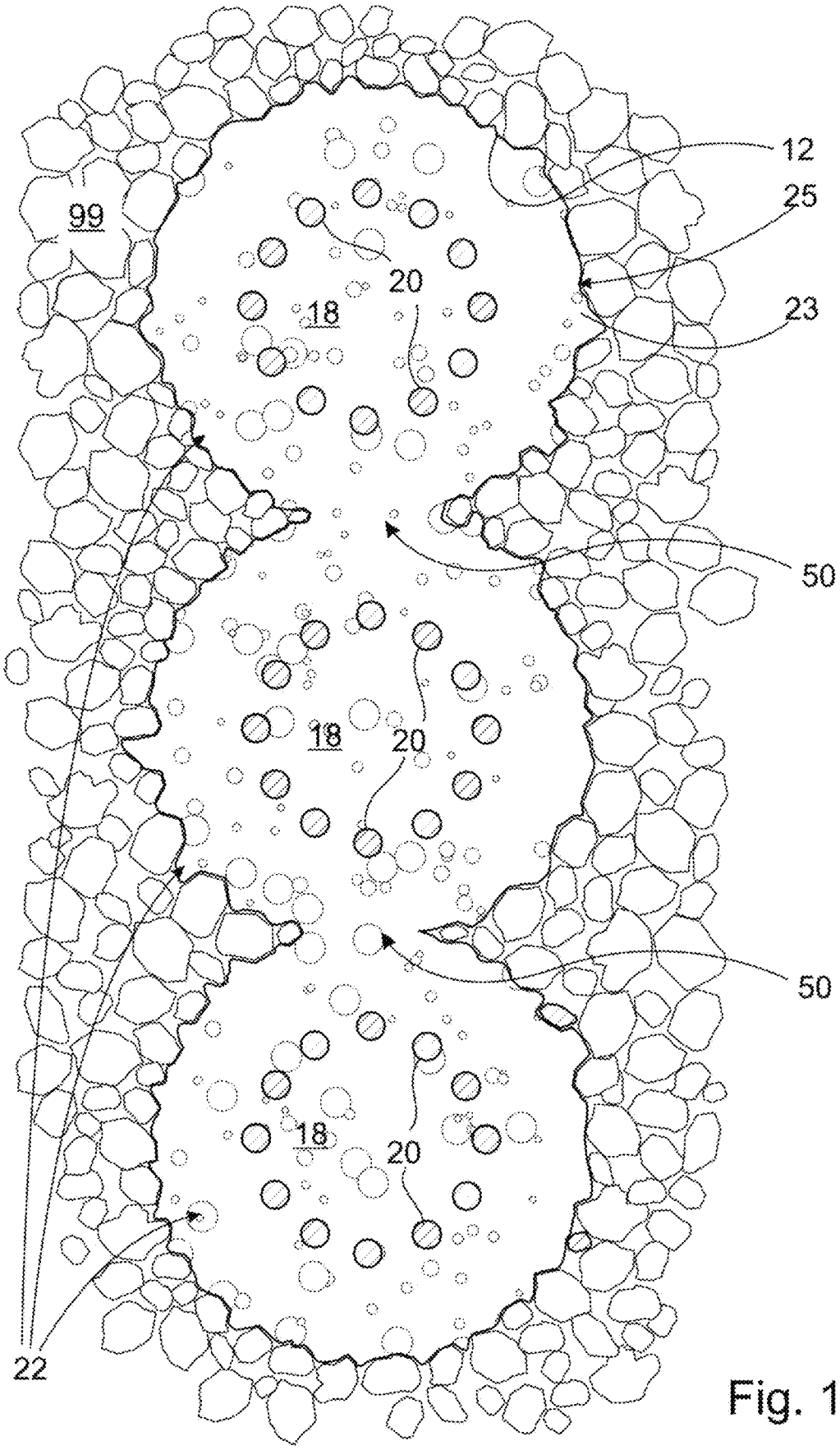
FIG. 1*e* shows the fifth stage of the method according to the invention, in which the pipe piles are lifted out of the drill holes by vibration.
Figure 4D:
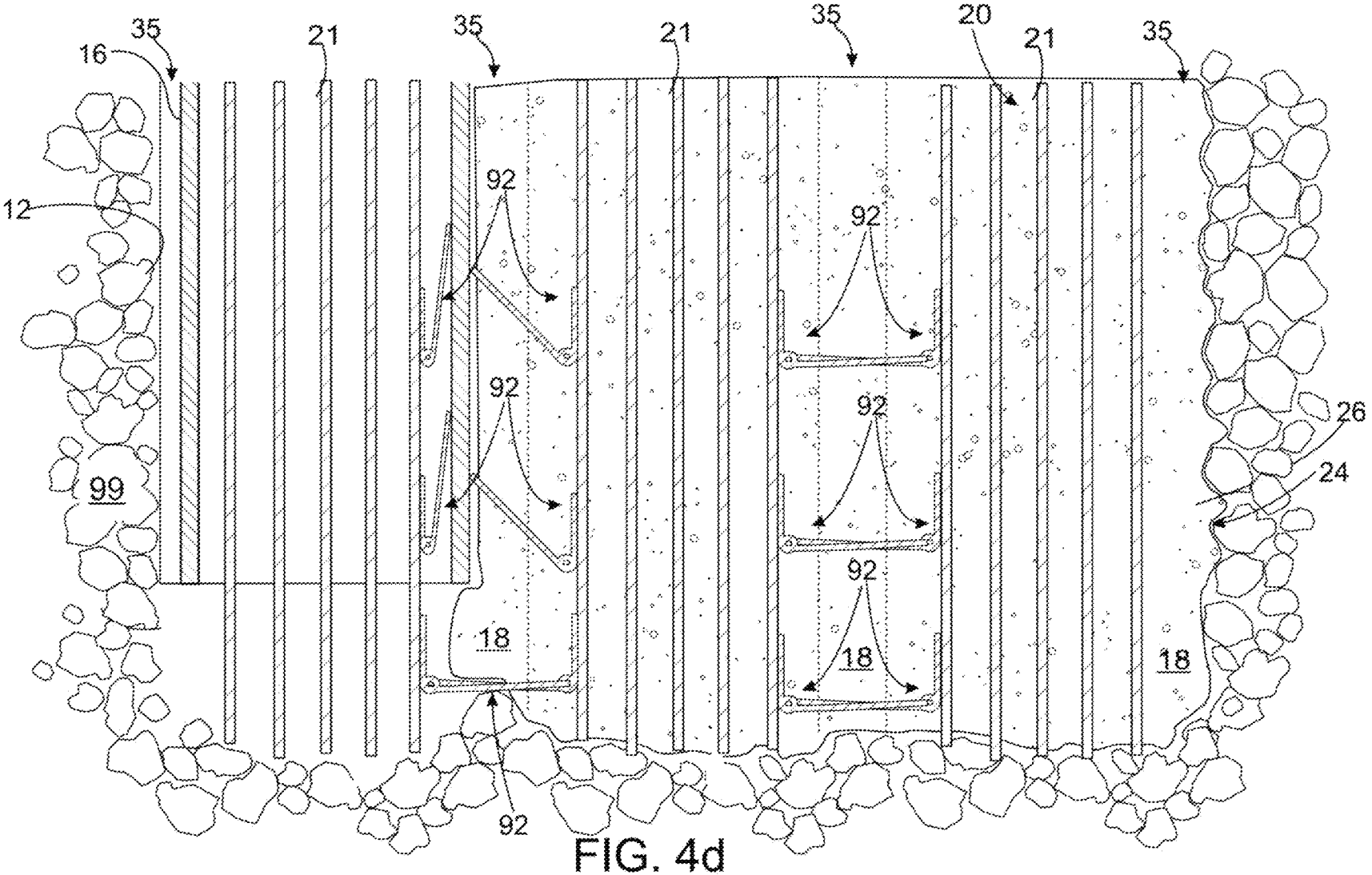
Figure 4E:
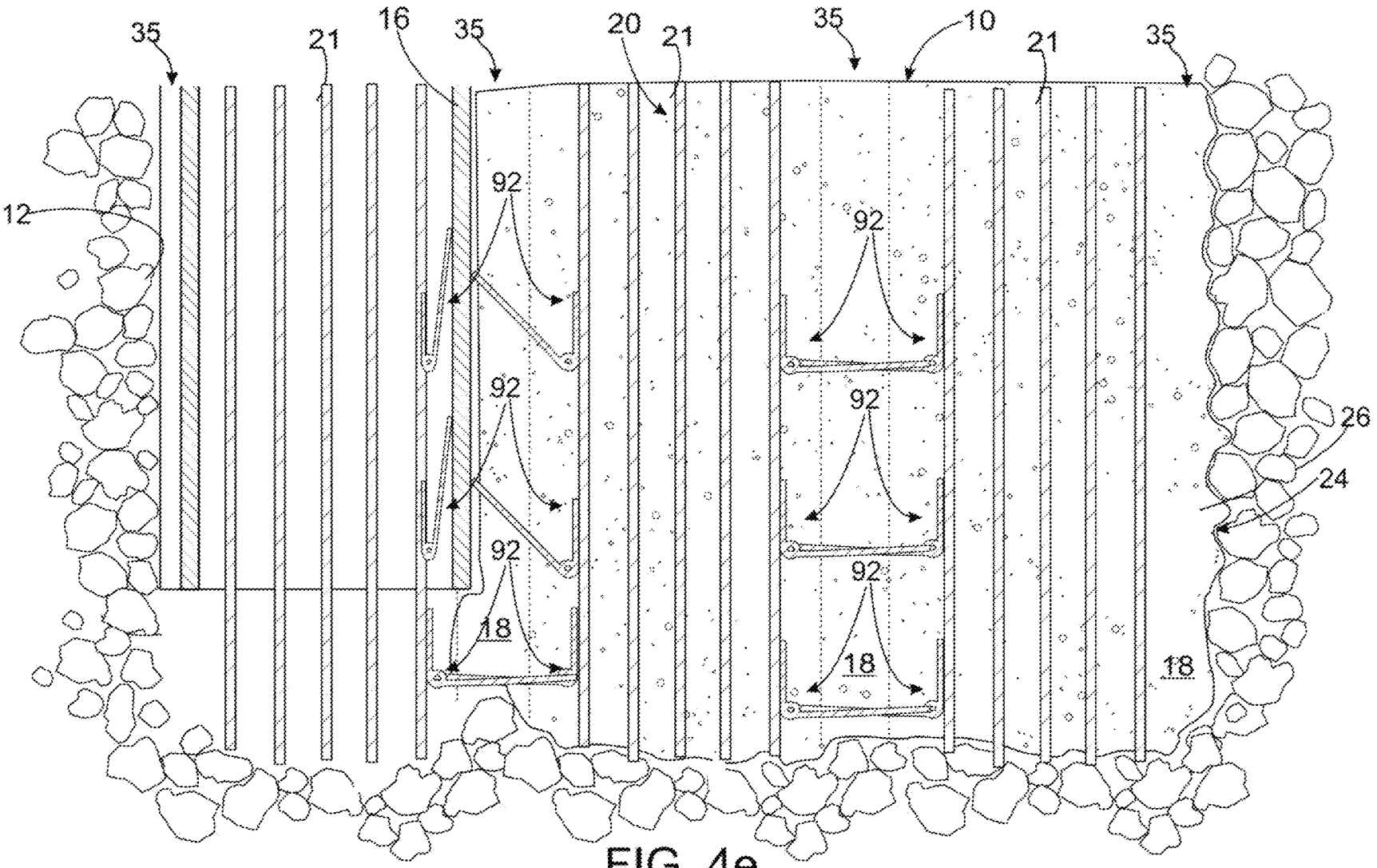

Once the pipe piles 16 have been cast full of concrete 18, the pipe piles 16 can begin to be lifted one at a time partly or completely out of the drill holes 12, before the concrete 18 bonds inside the pipe piles, changing from a fluid, workable concrete mass into a rigid one, according to FIGS. 4*c* and 4*d*. The pipe pile 16 is attached at its upper end to a lifting device, which lifts the pipe pile 16 out slowly, while preferably vibrating the pipe pile 16. As a lifting device, the vibrating lifting device made by the German manufacturer ABI GmbH under the product name MRZV-VV, or Liebherr's LRB255 lifting device can be used. The lifting device grips the end of the pipe pile and lifts it upwards out of the drill hole while vibrating it. The vibration of the pipe pile 16 also vibrates and compacts the concrete 18 inside the pipe pile 16. At the same time as the pipe pile 16 is removed, the still fluid concrete between the concrete 18 and the drill hole 12 spreads laterally by gravity, filling the drill hole 12 and forming a concrete pile 22 and spreading between the drill holes 12 connected to each other to form a unified pile wall 10. At the same time, the vibration of the pipe pile 16 compacts the still fluid concrete 18 in the drill hole 12 against the ground 100. In other words, the outer surface 23 of the concrete pile 22 forms a contact surface 25 against the ground 100, which is shown in FIGS. 1*e*, 2*a* and 2*b*. If spring reinforcements are used in the pile wall, the spring reinforcements are able to spread between the concrete piles, thus reinforcing the entire pile wall. Alternatively, the pipe piles can also be raised without vibration, but the use of vibration is the preferred manner of implementation, as it compacts the concrete at the same time.

According to FIG. 2*b*, the pile wall 10 can also include transverse reinforcement element such as a beam 114 to which the fenders of harbour ships can be attached, can be easily attached to the steel structure of the pipe pile 16 at the upper end of the pipe pile 16.

According to FIG. 2*a*, a preferably cast transverse support beam 71 can also be formed on the exposed pile wall 10 in connection with the pile wall, on the construction side 73 of the pile wall 10. The construction side 73 of the pile wall 10 refers to the side on which the building or similar is created, the opposite side of the pile wall 10 being, in turn, the stable side 75. The pile wall 10 can also be anchored in the stable layer 60 of the ground 100 on the opposite side of the pile wall 10 relative to the support beam 71, with the aid of anchors 77. The anchor 77 then penetrates both the support beam 71 and the pile wall's 10 concrete pile 22 and further extends to the ground's 100 stable layer 60, thus locking the pile wall 10 in place even more firmly. The pile wall 10 can also include a diagonal reinforcement 17.

Figure 5A:
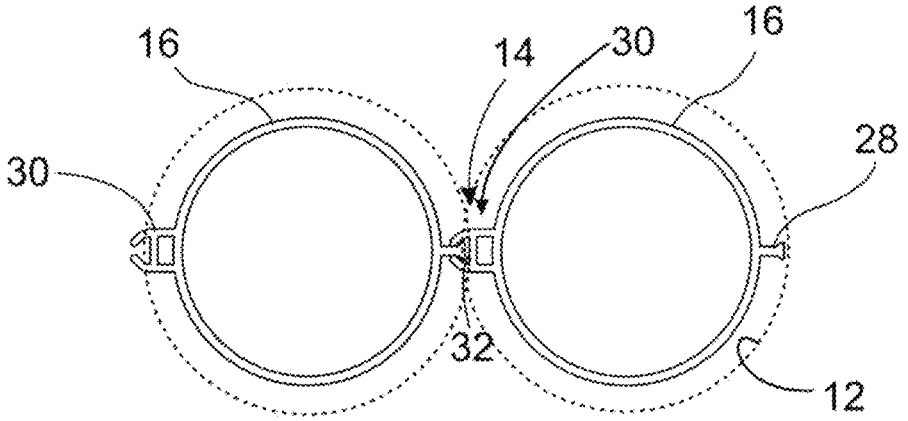
FIG. 5*a* shows alternative interlocks between the pipe piles.

According to FIGS. 5*a*, alternative interlocks 14 can be used when drilling the pipe piles to connect the pipe piles 16. In FIG. 5*a*, there is both a male interlocking member 28 and a female interlocking member 30 in each pipe pile. According to a different alternative, as discussed above in connection with FIG. 13, there are, in turn, pipe piles in which there are only male interlocking members, and the pipe piles are connected with the aid of an intermediate interlocking member. The intermediate interlocking member includes two female interlocking members. Thus, the male interlocking member to which the intermediate interlocking member attaches forms the female interlocking member of that pipe pile.

Figure 5B:
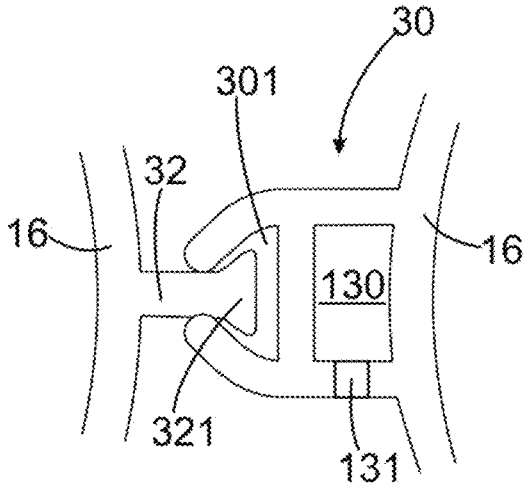
FIGS. 5*b* and 5*c* show enlargements of the interlocks of FIG. 5*a* used for injection of water and concrete.
Figure 5C:
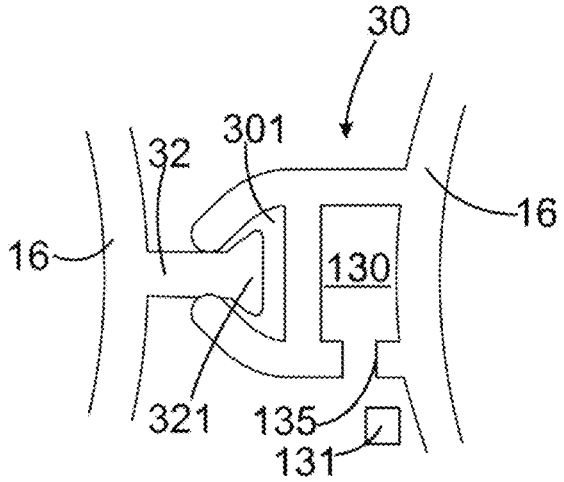

FIGS. 5*b* and 5*c* show enlargements of the interlocks 14 of FIG. 5*a* used for injection of water and concrete. Since the drill bit sits under pipe pile 16 and overlaps the pipe pile 16 by about 3 cm (commonly 2.5-5 cm), the pipe pile must be pushed to its final depth after the drilling process and the annular space of the rock must be filled in and closed. For this purpose, the end of the pipe pile is filled with about 2 $m^3$ of concrete and then the pipe pile is raised up and down (about 1 m) while simultaneously vibrating the concrete with a vibrator attached to the drilling rig. The pipe pile is eventually brought to its final depth. The vibrations and the raising and lowering of the pipe pile ensure that the entire cavity between the pipe pile and the stone, i.e., the inner surface of the drill hole, is filled with concrete.

To fill the perhaps existing annular space of a stabilized clay layer, cement mortar is subsequently pressed through injection channel 130 of RF member, i.e., female interlocking member 30, see FIG. 5*b*. The female interlocking member is cut open in the area of the clay layer before the pipe pile is installed and closed with plug 131. Due to the overpressure created when the cement suspension is pressed into the injection channel, this plug is opened, and the cement suspension fills the annular space around pipe pile 16 through hole 135 (FIG. 5*a* dotted lines around pile 16).

The channel at the top end of the pile is equipped with a pressure medium coupling that allows the pressurized fluid to be pumped during drilling along the channel of the female interlocking member to the drilling point downward.

The female interlocking member includes a connector or threaded connection to enable the above. The channel is otherwise plugged from the upper end. A nipple connected to channel 130 is installed in the female interlocking member to provide a supply pipe attached to it. The liquid can be water or water like substance & drilling fluid & bentonite or polymer.

In another embodiment the pipe pile 16 comprises male and female lock tongue and groove, called male and female interlocking members, where the female interlocking member 30 includes a channel 130 and, at the top end of the pile, connecting means for conducting liquid (water) or cement from the upper end of the pipe pile 16 to its lower end.

In another embodiment the connecting means include a connecting nipple at the top end of the channel, for attaching the supply pipe.

In another embodiment the channel 130 at the upper end of the pipe pile 16 is equipped with a pressure medium coupling through which pressurized fluid is pumped during drilling along the channel to the drilling point downward.

In another embodiment several substantially vertical parallel boreholes 12 are drilled into the ground 100 by using a drilling device 102, transferring a non-rotating pipe pile 16 to each drill hole 12 aft of the drilling device 100 with longitudinal interlocks 32, 30 which connect parallel pipe piles 16 by means of interlocks and a total diameter of the pipe pile 16 with interlocks is smaller than the diameter of the drill hole 12, flushing the drill hole 12 to remove drilling waste from the drill hole 12 using a medium, and casting concrete 18 into each pipe pile 16.

In another embodiment pipe piles 16 equipped with male (RM) and female (RD) interlocking members 30, 32 are used, where the female interlocking member 30 is equipped with a channel 130 to lead the liquid down and cast cement on the bottom of the pipe pile.

In another embodiment the channel 130 is provided with a plug 131 set at the selected height, which the plug is removed by pressure when casting cement, allowing cement to be injected at the selected height.

In another embodiment the pipe pile 16 comprises male and female lock tongue and groove, called male and female interlocking members, where the female interlocking member 30 includes a channel 130 and, at the top end of the pipe pile 16, connecting means for conducting liquid (water) or cement from the upper end of the pipe pile 16 to its lower end.

In another embodiment said connecting means include a connecting nipple at the top end of the channel, for attaching the supply pipe.

The groundwater level is preferably monitored, e.g,. manually in specific wells. The groundwater control can be applied also on those walls where the metal pipes remain in boreholes.

FIG. 3 shows the drilling device 102 as a whole. Drilling device 102 may be movable, for example, supported on a chassis with a crawler platform and a turret on which the drilling device 102 itself is supported. The drill bit 36 including reamer 56 of the drill device are rotated using the rotation device 74 via the drill rod 72. Pressured flushing air is supplied to drill bit 36 from compressed air instruments 76. The drilling device is intended for piping drilling, in which a protective tube 70 is fed behind of drill bit 36, which protective tube 70 is shown only partially for simplification in FIG. 3. Drill impactor equipment, rotary equipment, pneumatic equipment, and other peripheral equipment may be fully compliant with the technical level. When drilling with a drilling device, the drill bit 36 rotates with protective tube 70 following the drill bit 36 without rotation.

RD pipe piles 16 are suitable for waterproof installations. The tightness between individual pipe piles is usually produced by the male and female interlocking members 30, 32 (see FIGS. 5*a*, 5*b*, 5*c*). Here wide female interlocking member 30 interlocks in its groove 301 the thin male interlocking member's 32 T-flange 321 completely. The inside of female interlocking member 30, i.e., groove 301 is filled with bitumen before installation so that the interlock has a good seal. Additional cement mortar can be pressed through channel 130 of the female interlocking member 30 later to fill the overlapping annular space and seal rock integration. When making a pile wall, the female interlocking member 30 is always inserted into male interlocking member 32 from above. Therefore, the first pipe pile must be equipped with two male interlocking members. All subsequent pipe piles have female locking members 30 on the side of the already installed adjacent pipe pile and male interlocking member 32 on the free side. The reason for this is that the male interlocking member 32 is shorter than female interlocking member 30, so the reamer does not damage it when the neighboring pipe pile is drilled.

The embodiment of the method disclosed with reference to FIGS. 5*b* and 5*c* is also useful in ordinary pile installations, i.e., when the pipe piles remain completely in the ground (not a part of this invention).

If it is wished to improve the tightness of the pile wall other than by altering the mix of the concrete, concrete injection can be used during the lifting of the pipe piles, according to a first embodiment in the method. Concrete can be injected through a female interlocking member as the pipe pile is being lifted. The pile wall then receives additional concrete in the area between the concrete piles, which reinforces the structure and improves its tightness.

Figure 7:
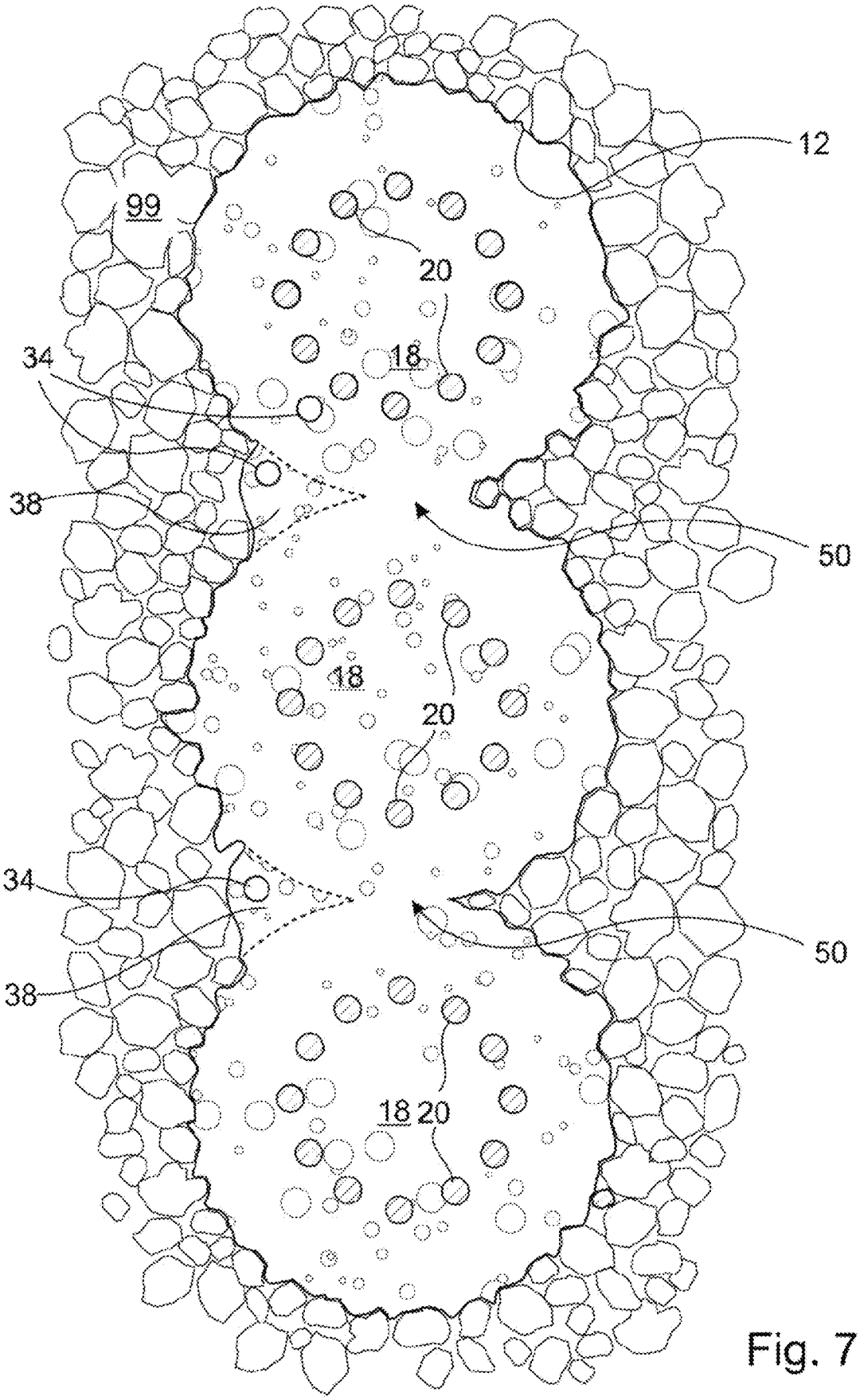
FIG. 7 shows a top view of extra compaction according to another embodiment of the pile wall.

According to another embodiment, an injection pipe can be temporarily locked to the pipe pile by a locking means, which is released from the pipe pile when concrete is cast into the pipe pile or when the pipe pile is lifted and remains in the bottom of the drill hole from the weight of the concrete. The injection pipe 34 is shown in FIG. 7 and can be located, according to FIG. 7, either inside the concrete 18 of the concrete pile 22, or outside the concrete pile 18. The injection hose 34 can be split over its length, except for the ends, when during injection the concrete is able to fill possible cavities remaining in the concrete piles. The injection hose's diameter can be, for example, 15-25 mm The locking means can be, for example, a metal sheet welded lightly to the side of the pipe pile, which presses the injection hose against the pipe pile while the pipe pile is drilled and detaches by the concrete's weight or when the pipe pile is lifted, pressing the injection hose under it in the drill hole. After the pipe pile is lifted, additional concrete or sealant can still be injected into the drill hole, which ensures the water-tightness of the pile wall. The injection pipe can be, for example, a steel reserve pipe.

Figure 6:
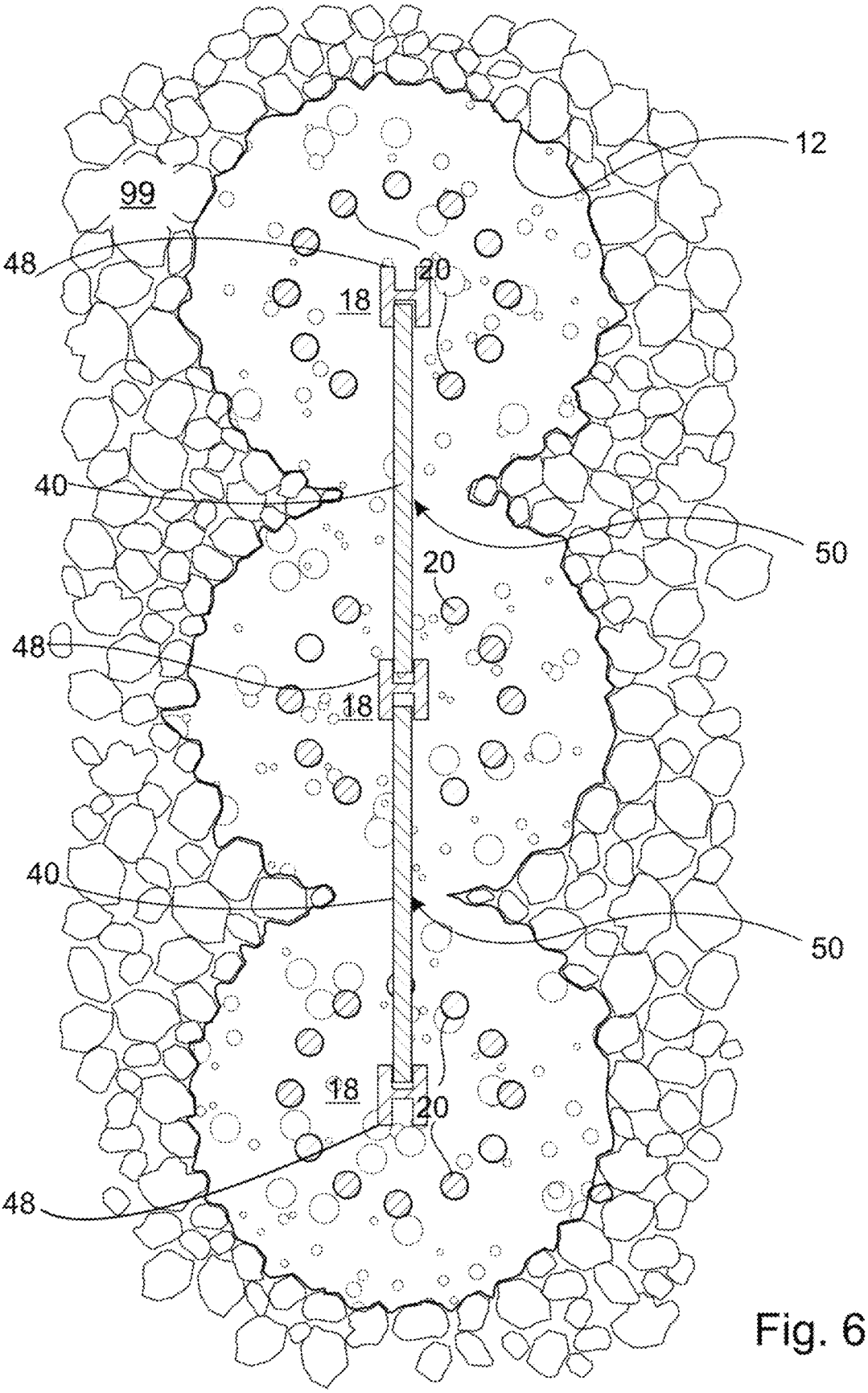
FIG. 6 shows a top view of the use of transverse reinforcements, according to one embodiment of the pile wall.

FIG. 6 shows a third embodiment, in which the durability and water-tightness of the pile wall 10 is improved with the aid of a separate support plate 40. For the support plate 40 there are inside the pipe piles, for example, H beams or other similar guide supports 48 placed inside the pipe piles in connection with reinforcement, which remain inside the concrete cast in the pipe pile. When the pipe piles are lifted out of the drill holes, the support plate 40 connecting the concrete piles 22 can be driven between the H beams 48, when the H beams or similar supports guide the support plate's 40 impacts inside the concrete pile 22. In this embodiment, the support plates act as transverse reinforcements in the pile wall.

In this connection, it should be understood that the brackets described in the present application can also be used generally as part of the drilled pipe piles in connection with the construction of pile walls, and their use is not restricted only to the method according to the invention. The brackets can thus be part of the pipe pile, which are joined to the pipe pile's outer surface at the end of the pipe pile next to the drilling device's ring bit and at the brackets the pipe pile's diameter is 1-4 mm larger than the drill hole being drilled. Thus, the brackets stabilize the pipe pile being placed, particularly in its rock-drilled portion, so that lateral loads, acting in the direction of the previously drilled pipe pile, are larger for the placed pipe pile.

According to FIGS. 1*a*-1*d* and 12, in one embodiment of the method according to the invention, at least one plough protrusion 82 is welded next to the interlock 14 at the end 84 of the pipe pile 16 entering the drill hole 12 first, before the pipe pile 16 is drilled into the ground 100, which plough protrusion 82 is a continuous distance of a sector on the pipe pile's 16 outer circumference and protrudes from the pipe pile 16 by at most by the same amount as the reamer used in the drilling device 102. The plough protrusion 82 is intended to displace ground 100 when lifting the pipe pile 16 to make the joining of the concrete piles 22 more effective. The plough protrusion thus 'ploughs' the ground 100 from in front to the side, thus enlarging the connection between two adjacent drill holes 12, which can, in some cases be only the width of the interlock and permit the concrete to effectively spread from one drill hole 12 to another, effectively joining the adjacent concrete piles 22 to each other. At the same time, the plough protrusion 82 can form a vacuum behind itself, as the concrete surrounds and fills the space left in the pipe pile's drill hole as the pipe pile is raised and vibrated. The vacuum in turn sucks concrete effectively between the drill holes, thus joining the concrete piles.

Figure 12:
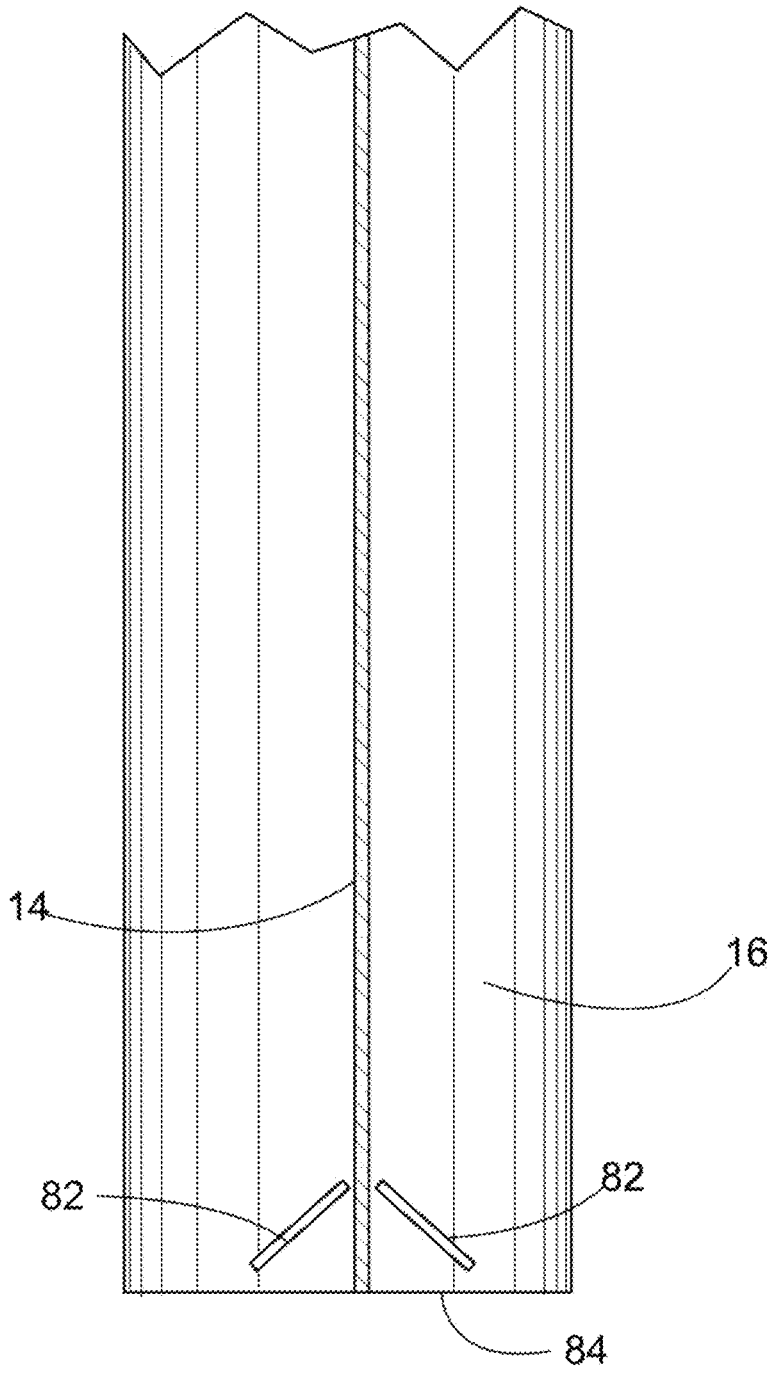
FIG. 12 shows the plough-protrusions of the pipe pile and its surface, formed according to one embodiment, seen in the longitudinal direction of the pile wall.

In the embodiment shown in FIG. 12, the plough protrusions 82 are plates welded to the pipe pile 16, which are at an angle of, for example, 30-60°, preferably 40-50° to the longitudinal direction of the pipe pile 16. This is s preferred form of implementation, but it should be understood that the plough protrusion can also be a casing structure transversely to the pipe pile, or some other protrusion that displaces ground from in front when raising the pipe pile. The plough protrusion can be formed in a sector of the pipe pile of a minimum of 1°, preferably 5° of the pipe pile's perimeter and a sector of a maximum of 50°, preferably 15°.

Figure 8:
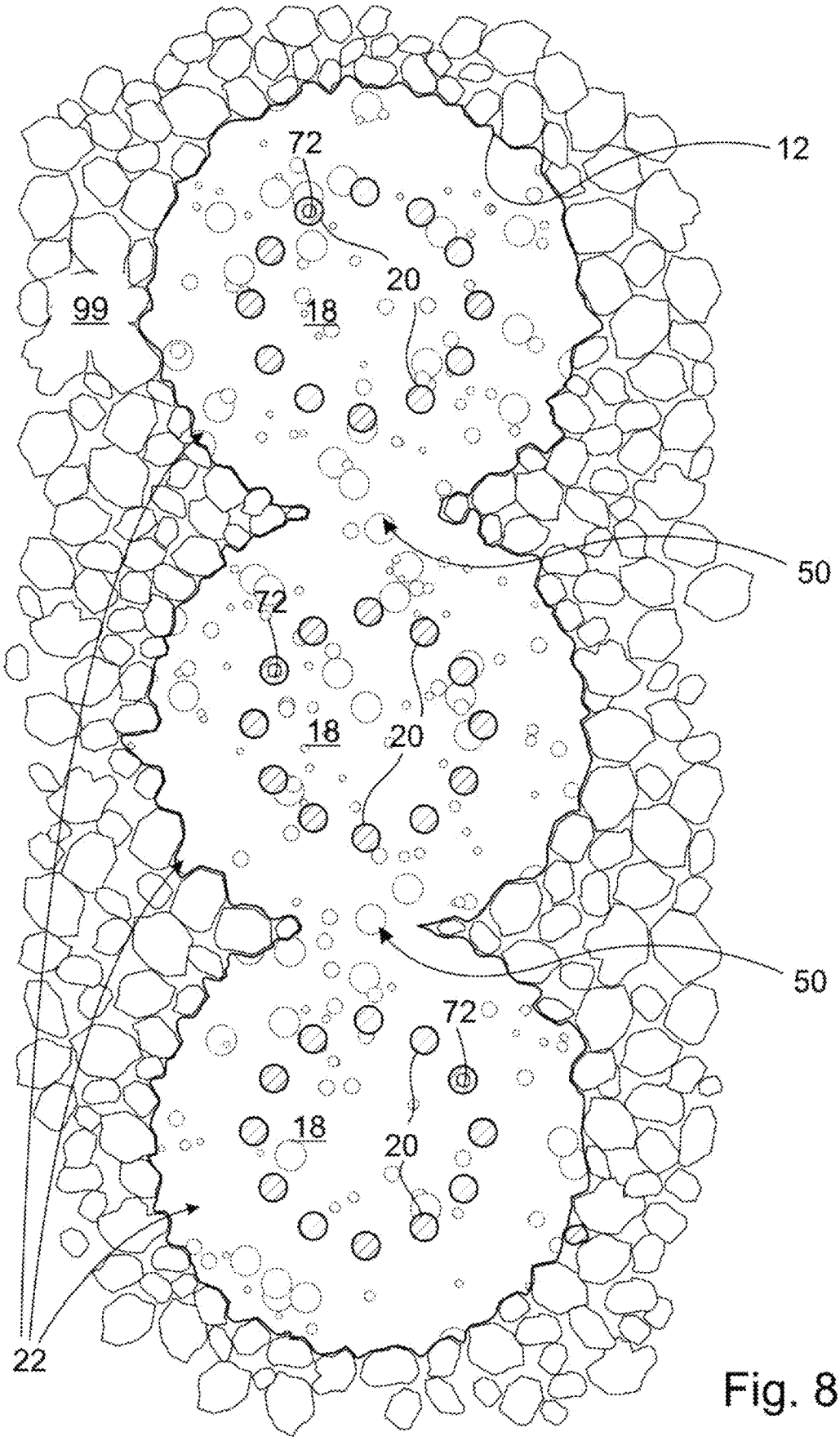
FIG. 8 shows an embodiment of the pile wall, in which the reinforcement includes hollow reinforcement and a reserve pipe.

FIG. 8 shows an embodiment of the method according to the invention, in which the reinforcements 20 preferably include at least one hollow reinforcement in each pipe pile 16, inside which a reserve pipe 72 is fitted. The reserve pipe 72 is protected during the casting of concrete in the pipe pile 16, so that the reserve pipe 72 remains empty. Once the pipe piles have been lifted, compaction mass or concrete can be fed through the reserve pipe, to ensure the pile wall's tightness. Alternatively, the pipe piles can be drilled only down to the rock surface, when a locking holes can be drilled into the rock through the reserve pipe, through which the concrete pile can be locked to the reinforcement by a rock bolt to the locking hole and through it to the rock.

Figure 9:
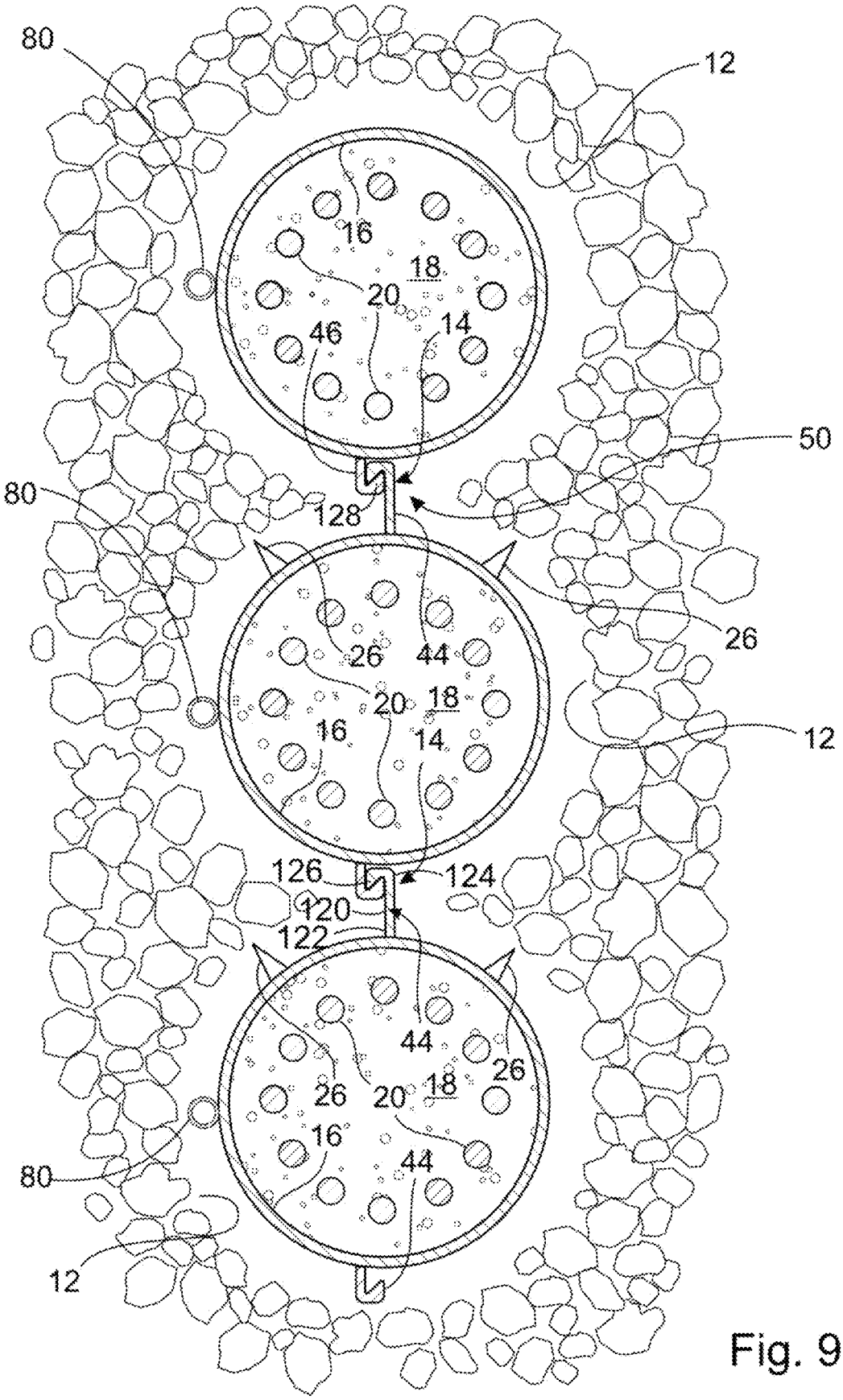
FIG. 9 shows an embodiment of the method, in which the pipe pile's outer surface includes a separate channel for feeding liquid lubricant.

FIG. 9 shows one form of implementation of the method according to the invention, in which separate channels 80 are formed in the outer surfaces of the pipe piles 16, through which liquid lubricant can be fed into the drill hole 12 outside the pipe piles 16. The liquid lubricant remaining between the drill hole 12 and the pipe pile 16 facilitates the lifting of the pipe piles by reducing the friction between the pipe piles and the drill hole. Instead of separate channels, the liquid lubricant can also be fed, for example, through the female interlocking members of the pipe piles' interlocking members, or using a separate channel formed in connection with the interlocking members.

According to an embodiment the interlocks 14 include, as illustrated in FIG. 9, a stem part 120 extending in a radial direction of the pipe pile 16 and comprising a first end 122 and a second end 124, wherein the first end 122 is attached to the pipe pile 16 and a hooked interlocking part 126 is attached to the second end 124. The hooked interlocking part 126 provides an interlocking fixation with the hooked interlocking part 126 of the interlock of the adjacent pipe pile 16, which prevents horizontal movements of the pipe piles relative to each other. This is because the pipe piles are neither able to move towards each other when the interlock grips the outer surface of the adjacent pipe pile nor away from each other since the hooked interlocks prevent a movement in this direction. Moreover, the length of the short interlocking member with respect to the stem part and the hooked interlocking part is such that the interlock of the adjacent pipe pile can only be installed against this interlock via the longitudinal movement of the pipe pile. The hooked interlocking part 126 is preferably formed by an interlocking arm 128. In other words, the distance between the tip of the interlocking arm 128 of the short interlocking member and the outer surface of the pipe pile is less than the length of the interlocking arm 128 in the longitudinal direction of the stem part 120 of the interlock between the ends 122 and 124 of the stem part 120.

As an alternative to using lubricant a separate material layer 29, which is arranged to reduce the friction between the concrete and the pipe pile, on the inner surface 27 of the pipe pile can, according to FIG. 1*c* be used. The material layer 29 can be, for example, of Teflon.

Figure 10:
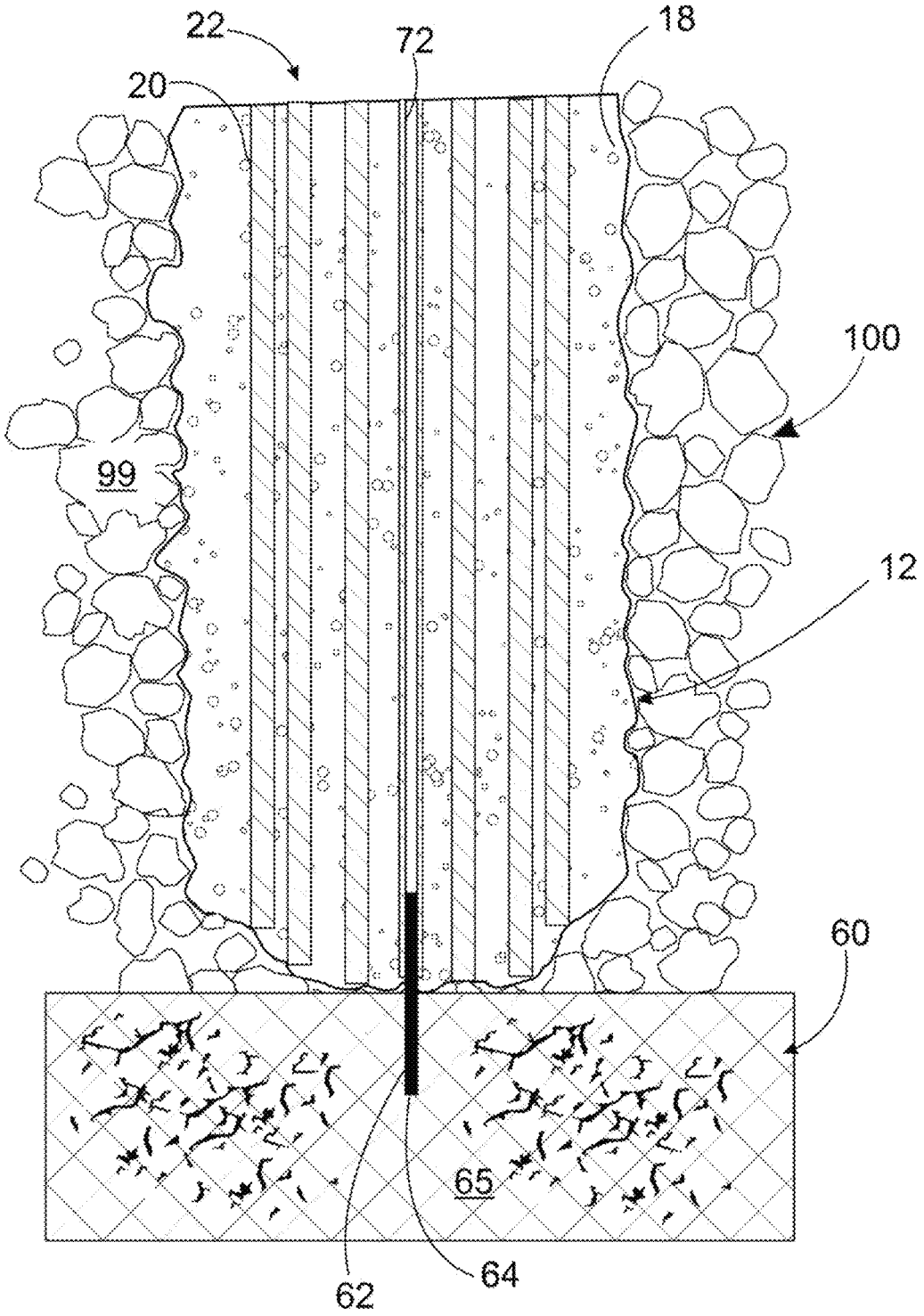
FIG. 10 shows a pile wall, in which a rock bolt is used for attachment to rock.

According to the embodiment shown in FIG. 10, in the case of the pipe piles, the pile wall can be drilled down to the upper surface of the rock 65 forming the stable layer 60. The reinforcement 20 includes a hollow reserve pipe 72, which is left empty when casting the concrete, and through which a locking hole 62 can be drilled into the rock, according to FIG. 10*a*. Finally, the pile wall is locked by setting a rock bolt 64 in the locking hole 62 through the reserve pipe 72, which holds the concrete piles 22 horizontally in place in the rock 65.

Figure 11:
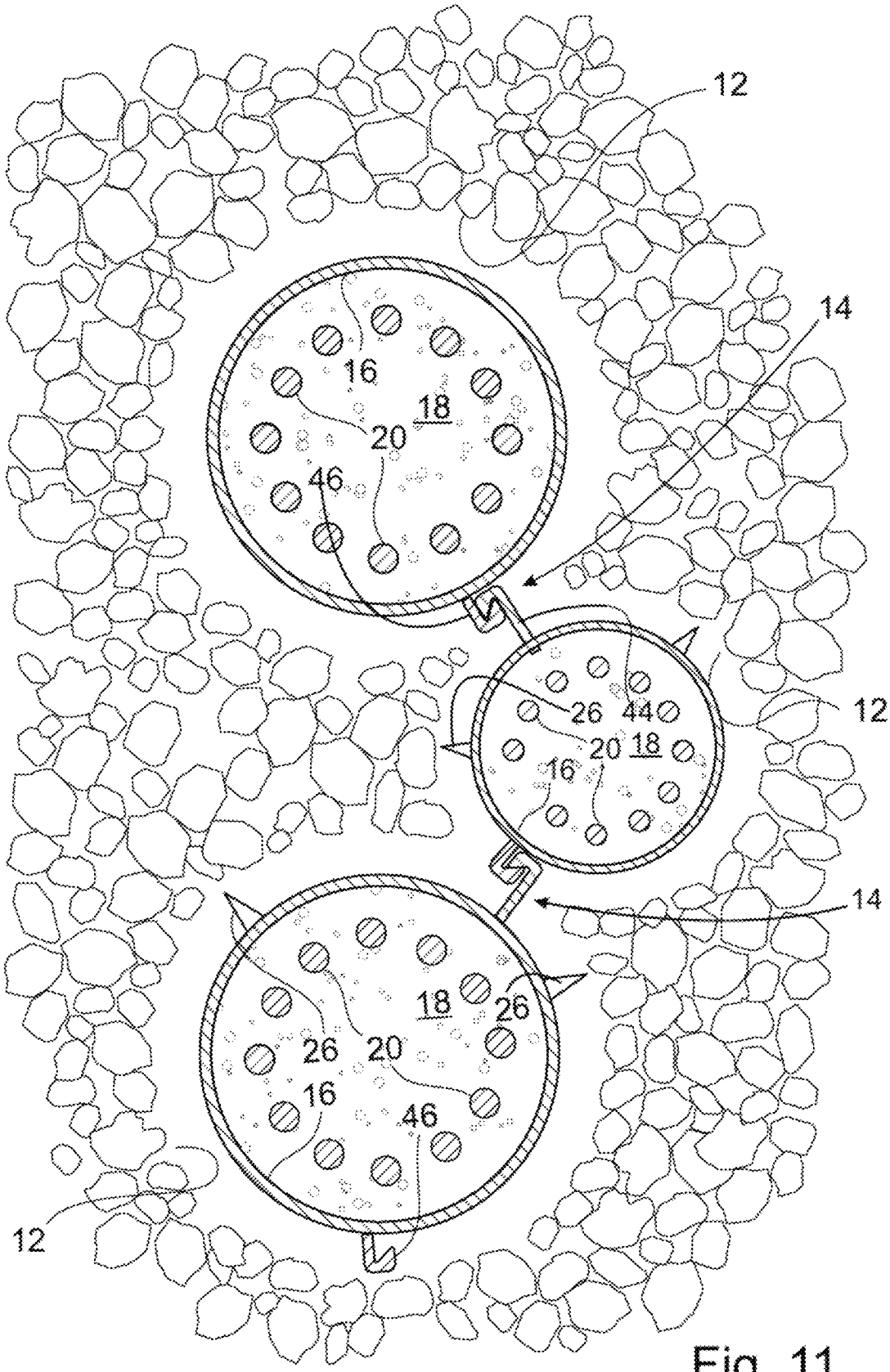
FIG. 11 shows a stage of the method according to the invention in making a pile wall according to the invention.

According to FIG. 11, the pile wall can also be formed in such a way that the pipe pile 16 between the upper and lower pipe piles 16 in the line is drilled to the side of the line, on that side of the line in which the soil pressure acting on the pile wall is greater. This single offset pipe pile 16 can have a smaller diameter than the other pipe piles. When the pipe piles are removed from the drill holes 12, the soil pressure presses this control pile outside the line tightly against the concrete piles in the line, thus ensuring the pile wall's tightness. The offset pipe pile can be otherwise the same in structure as the other pipe piles and the interlocks of the pipe piles joined to it should be compatibly located in the circle of pipe piles, relative to each other.

Though it does not belong to the invention, it can be envisaged that the idea of the method and pile wall according to the invention can also be implemented without the reinforcements fitted inside at least one pipe pile.

Figure 15A:
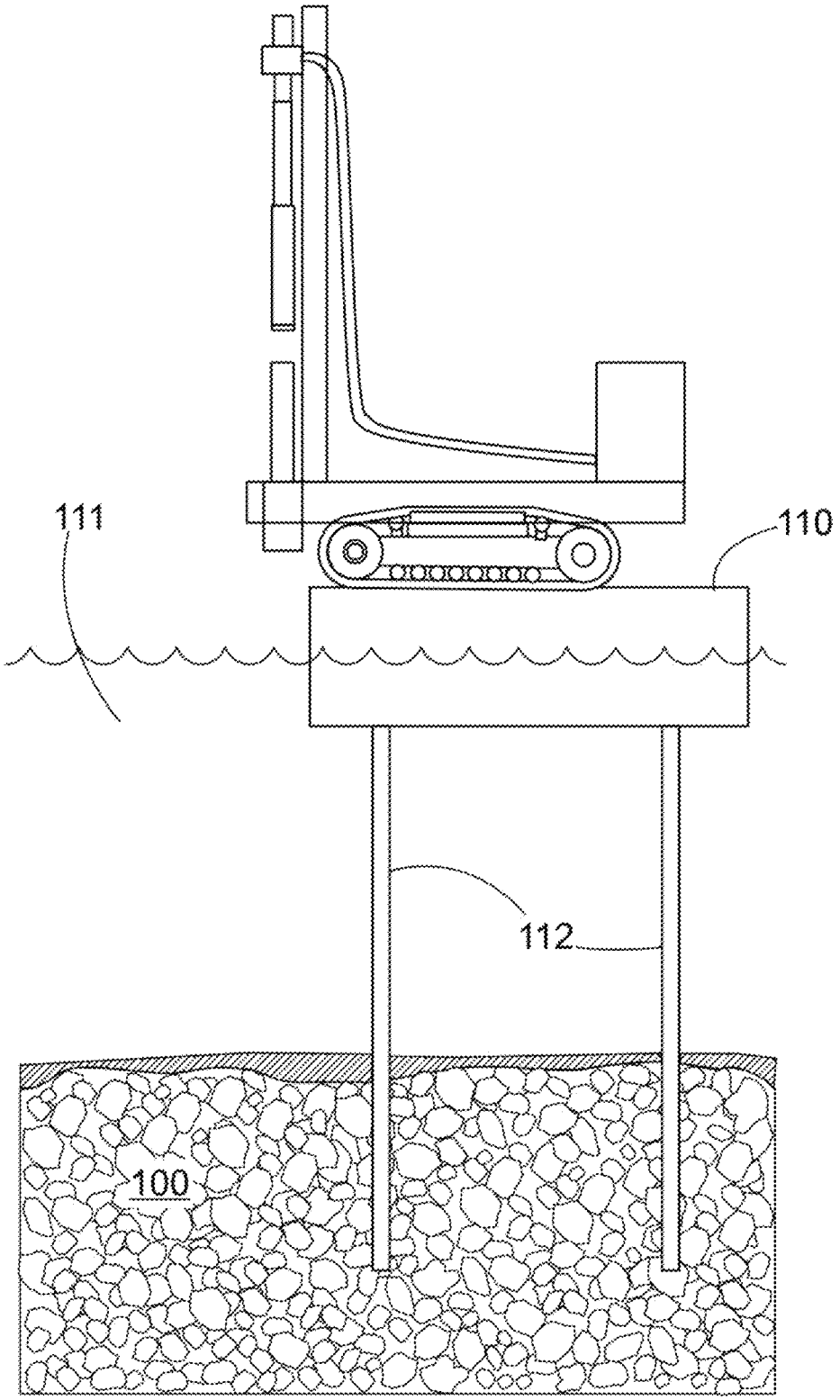
FIG. 15*a* shows a first step of an embodiment of the method according to the invention in which a drilling device is supported on a drilling platform.
Figure 15B:
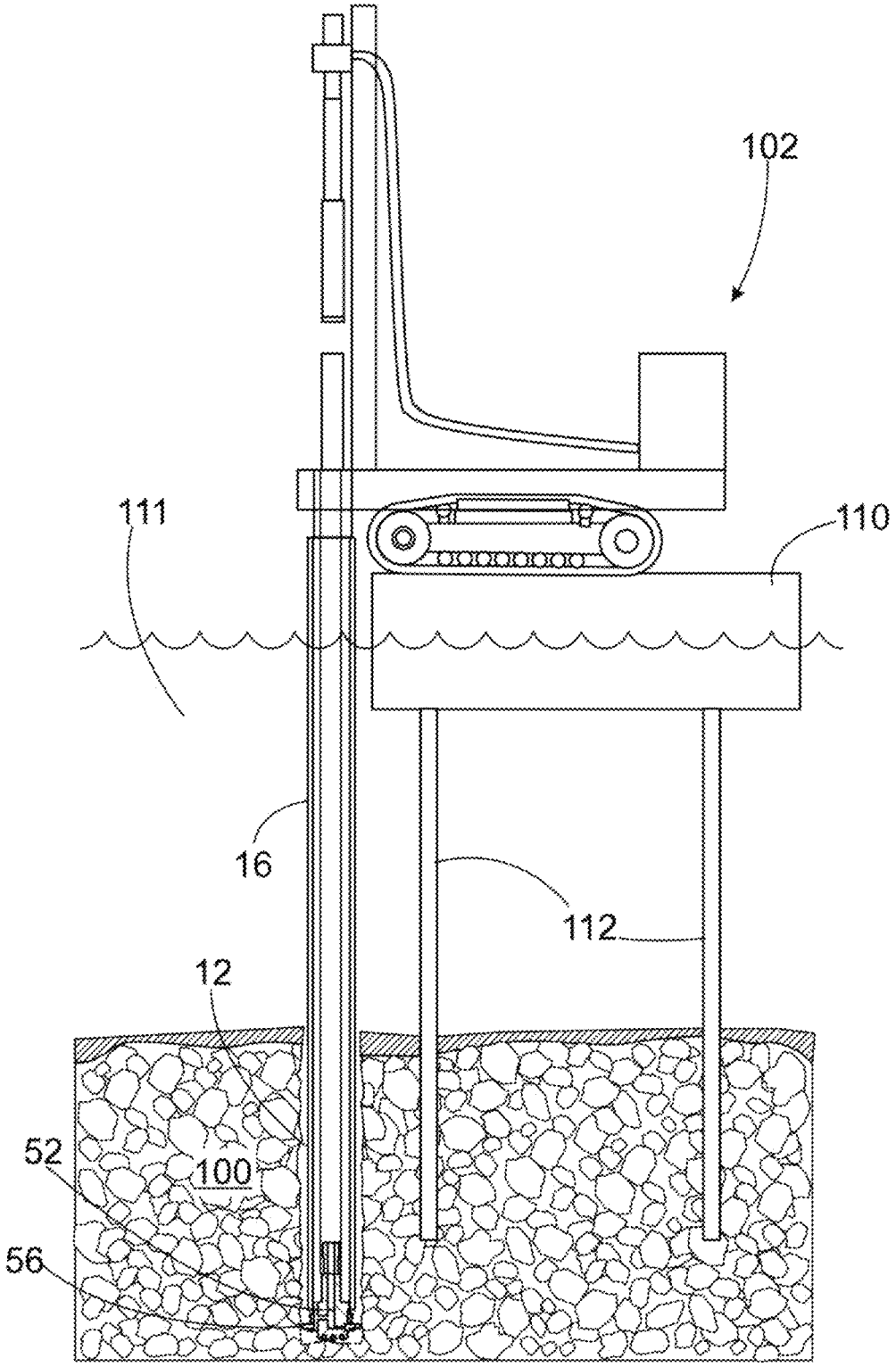
FIG. 15*b* shows a second step of the embodiment of the method according to the invention in which a drill pile is drilled into ground under water by means of the drilling device.
Figure 15C:
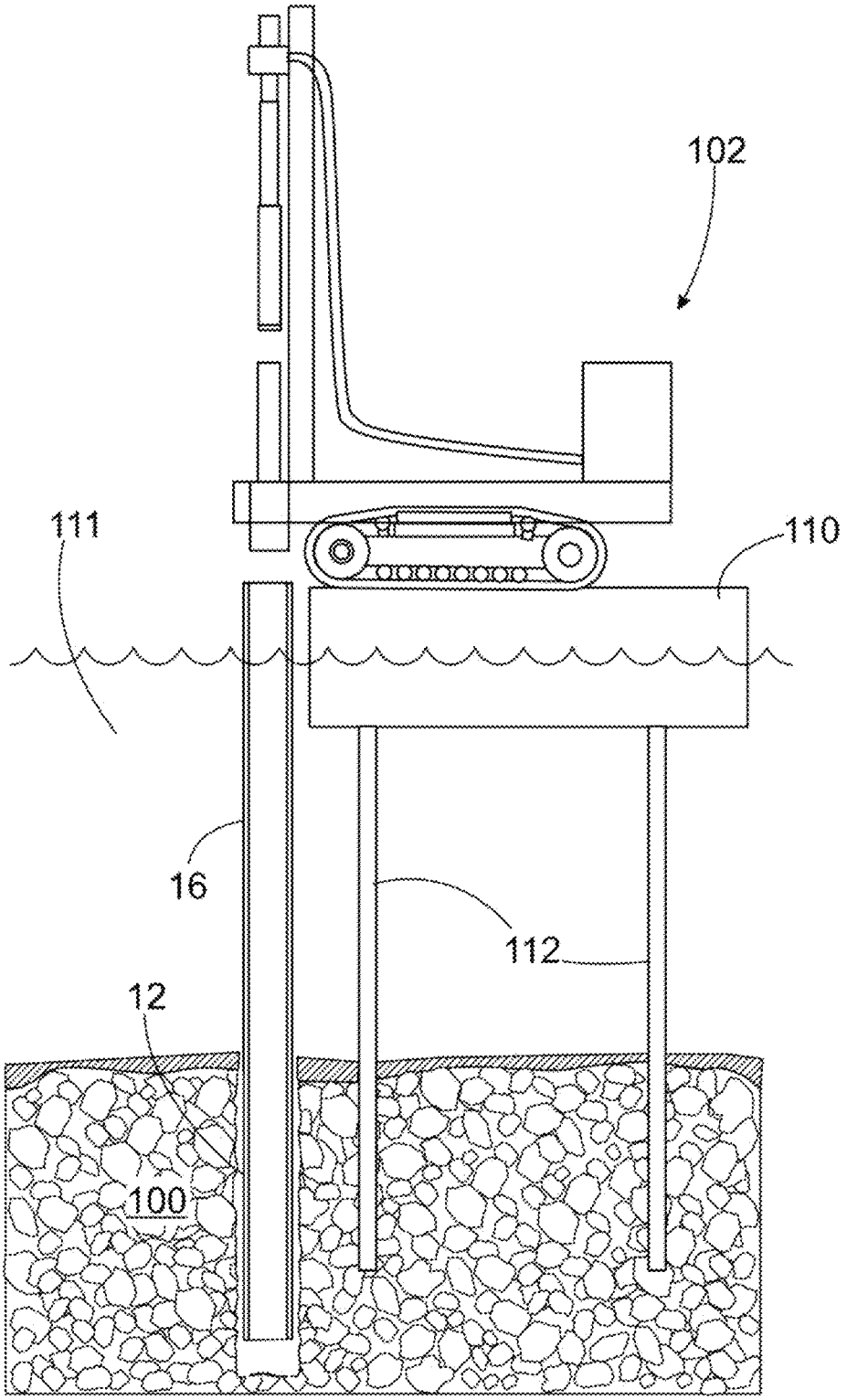
FIG. 15*c* shows a third step of the embodiment of the method according to the invention in which the drill pile is drilled into the ground under water and the drilling device is raised out of the drill pile and drill hole.
Figure 15D:
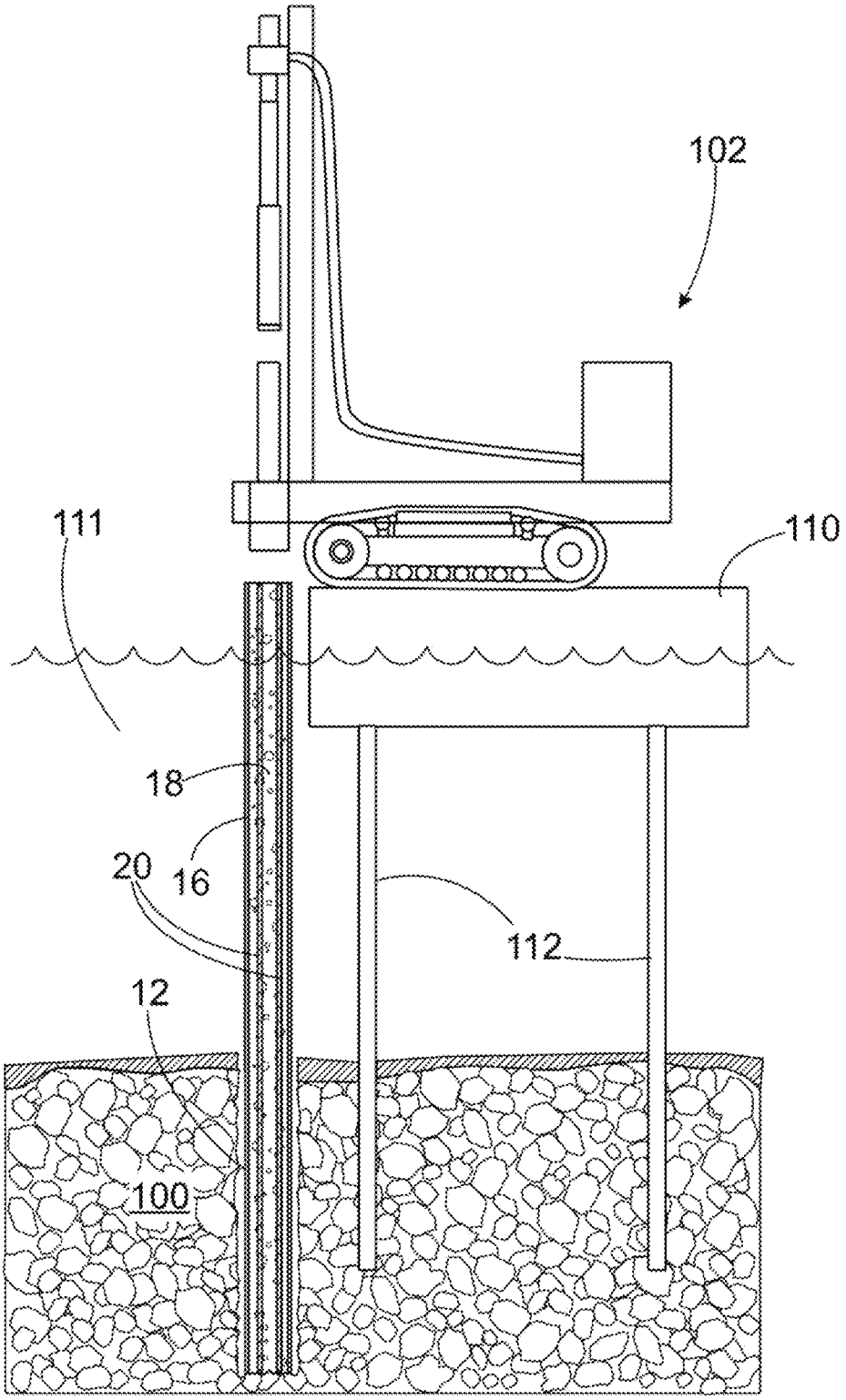
FIG. 15*d* shows a fourth step of the embodiment of the method according to the invention in which reinforcements are installed inside the drill pile and the drill pile is filled with concrete.
Figure 15E:
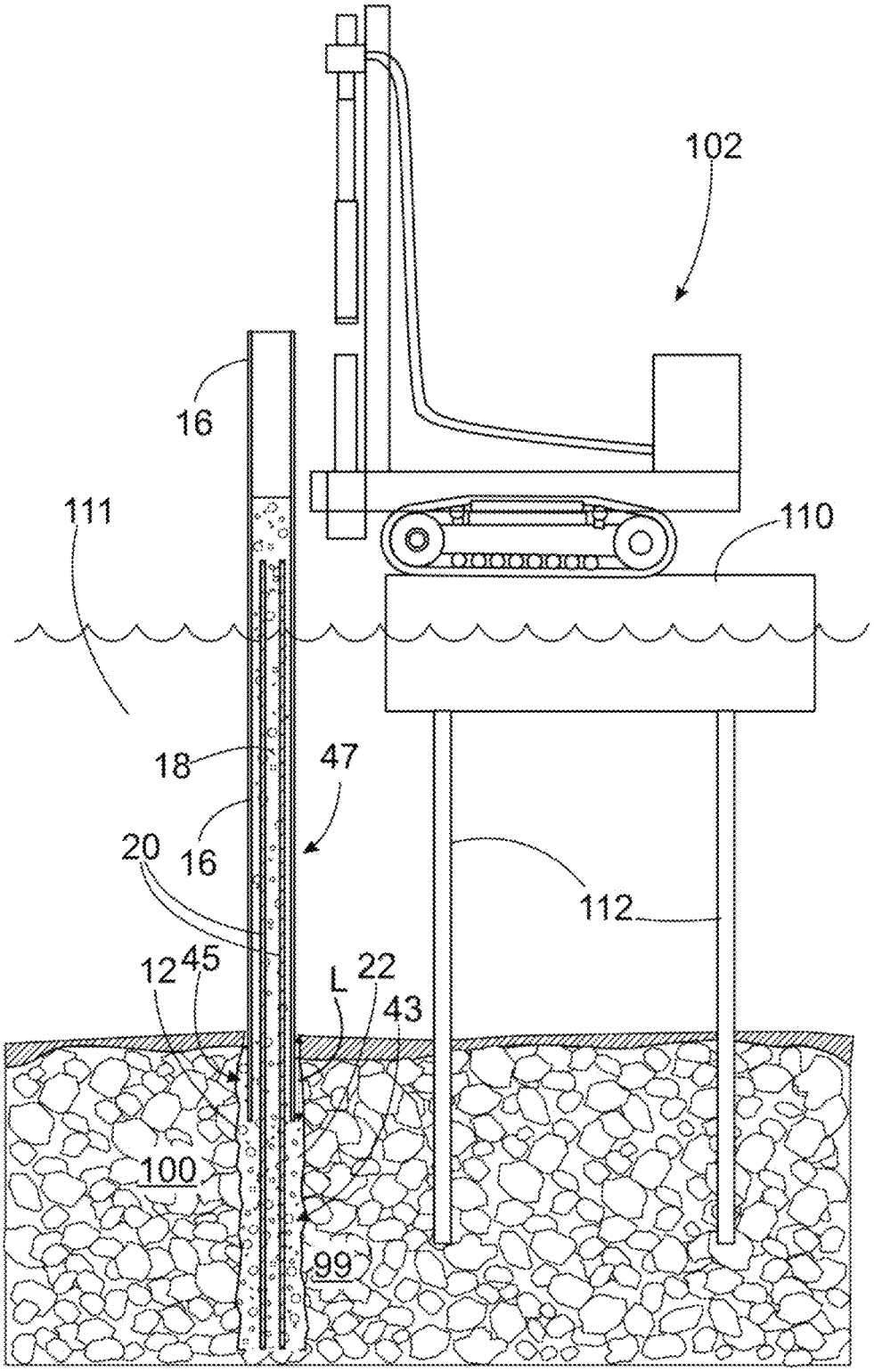
FIG. 15*e* shows a fifth step of the embodiment of the method according to the invention in which the drill pile is raised upwards by means of the drilling device.
Figure 15F:
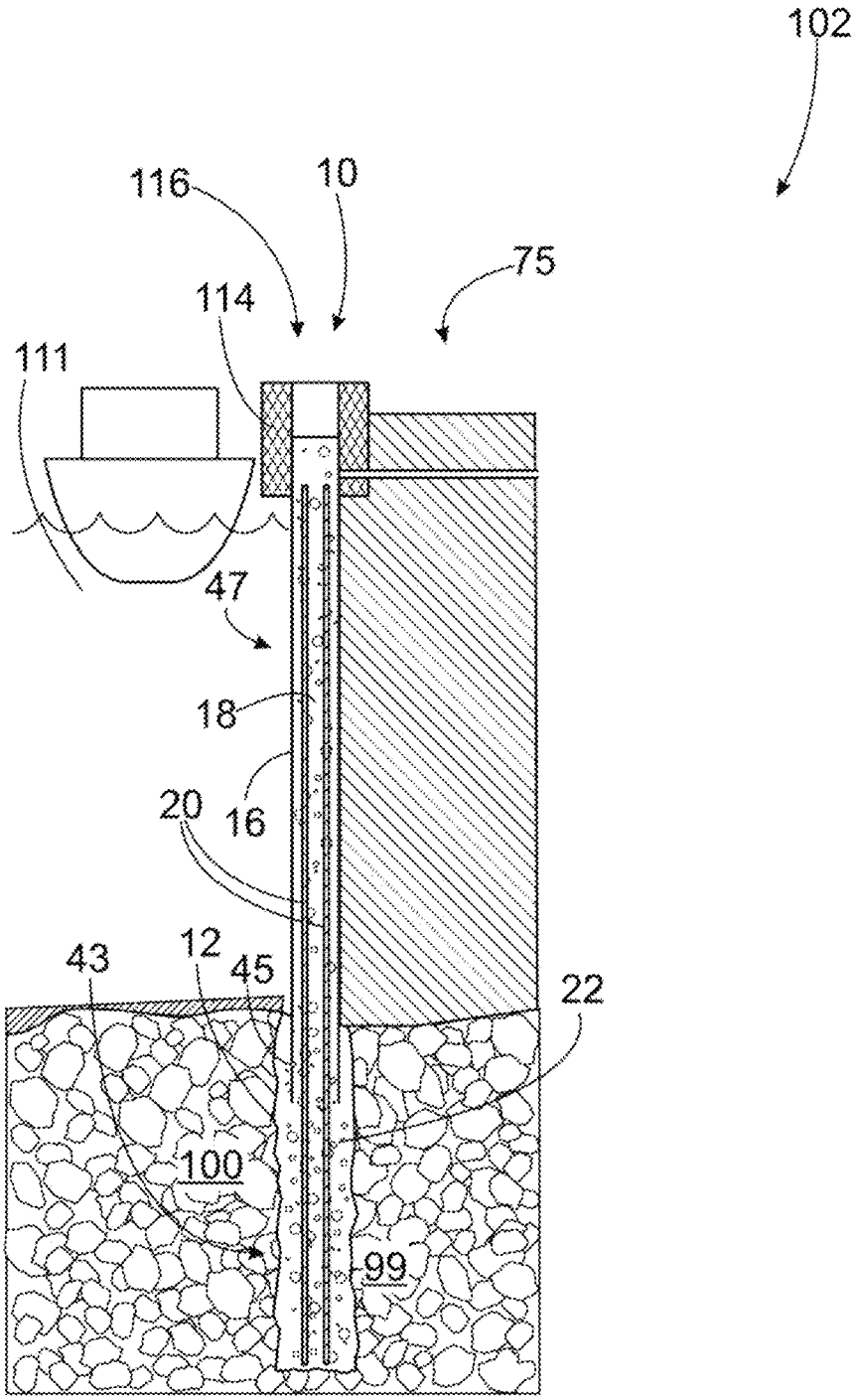
FIG. 15*f* shows a sixth step of the embodiment of the method according to the invention in which the part of the drill pile that extends beyond the concrete pile is cut off and the land-facing wall of the wall structure is filled with backfill.
Figure 15G:
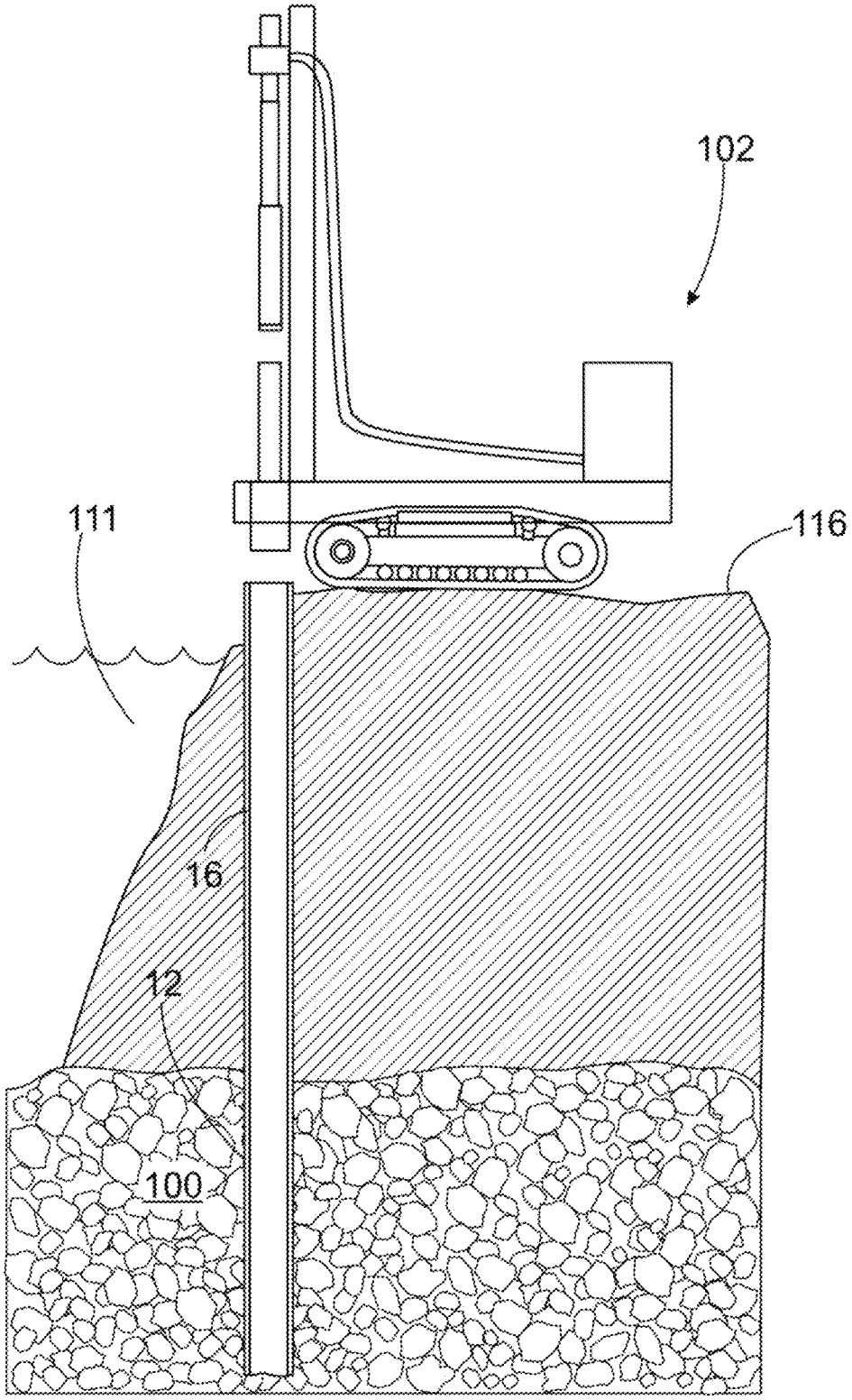
FIG. 15*g* shows an alternative embodiment to the one shown in FIG. 15*c* in a second step of the method according to the invention in which the drill pile is drilled into the ground under water and the drilling device is raised out of the drill pile and drill hole, the drilling being carried out from a backfill.

An embodiment of the invention shown in FIGS. 15*a*-15*g* is intended for the formation of a pile wall in contact with a body of water, preferably at a shore or in a body of water close to the shore, for example in a harbour. A drilling device 102 can be supported during drilling on a platform 110, which is in turn supported on the ground 100 by means of support legs 112. Alternatively, drilling can be carried out from the top of a backfill made in the body of water as illustrated in FIG. 15*g*.

The pipe pile 16 is preferably pulled behind the pilot bit 52 in the drilling device 102, the pipe pile 16 being connected in a non-rotating manner to the rear of the rotating pilot bit 52 by means of a ground shoe 54, as illustrated in FIG. 4*a*. The drill hole 12 of FIG. 15*b* is preferably drilled to a depth in the ground 100 that the drill hole 12 reaches the so-called stable layer in the ground 100, said stable layer being stationary and not moving in a horizontal direction. The stable layer is indicated in FIG. 2*b* by the reference number 60. Such a layer can be a layer of so-called non-cohesive soil. A sufficient depth dimension by which the drill hole should preferably extend into the stable layer is at least one metre, preferably 2-4 m. When the drill hole 12 has been drilled to a sufficient depth, the pilot bit 52 is detached from the ground shoe 54, for example by means of a bayonet mount, and is raised out of the drill hole 12 while the pipe pile 16 remains in the drill hole 12 as shown in FIG. 15*c*. FIG. 15*e* indicates the part of the pile wall 10 in the stable layer, preferably in moraine, i.e., the concrete piles 22, by the reference number 43, the portion of the pipe pile 16 that remains in the stable layer of the ground 100 by the reference number 45, and the part of the pipe piles that remains above the ground 100 in contact with the water by the reference number 47.

When the desired width of the pile wall 10 to be formed has been reached by drilling into the ground 100 a desired number of pipe piles 16 connected to each other by means of interlocks, reinforcements 20 can be installed inside the pipe piles 16, as illustrated in FIG. 15*d*. Resources permitting, the installation of the reinforcements 20 can begin for a part of the pipe piles 16 while other pipe piles 16 are still being drilled into the ground 100. Preferably, in the reinforcement, rebars or some other analogous reinforcing bars used for reinforcement are lowered into the pipe pile 16.

Preferably, after the installation of the reinforcements 20, concrete 18 is poured into the pipe piles 16 as illustrated in FIG. 15*e*, in which concrete 18 the reinforcements 20 remain. The pipe pile 16 acts as formwork for the concrete 18. The concrete 18 fills the interior of the pipe pile 16, thus forming a concrete pile 22 of reinforced concrete. If necessary, a selected binder can be mixed into the concrete 18 in order to improve the water tightness of the concrete 18.

Alternatively, the concrete can be poured into the pipe piles already before the installation of the reinforcements, in which case, however, it is necessary to press the reinforcements into the freshly poured concrete by vibration.

2-100 pipe piles, preferably 5-50 pipe piles, can be drilled into the ground in one substantially uninterrupted casting section before the raising of the pipe piles is initiated. The pipe piles are raised before the concrete sets and the fluid concrete paste becomes rigid, after which the concrete begins to harden, and it becomes very difficult or even impossible to raise the pipe pile without breaking the structure of the concrete pile. The length of a casting section can be influenced by using retarders in the concrete mixture, which delay the setting of the concrete and thus lengthen a time period for raising the pipe piles.

When the pipe piles 16 have been filled with concrete 18, the pipe piles 16 can be raised upwards one at a time from the drill holes 12, as illustrated in FIG. 15*e*, as the concrete 18 sets inside the pipe piles, changing from a fluid, pliable concrete mass to a rigid mass. The pipe pile 16 is attached by its upper end to a lifting device, which slowly lifts the pipe pile 16 while simultaneously preferably vibrating the pipe pile 16. For example, a vibratory lifting device known under the product designation MRZV-VV from the German manufacturer ABI GmbH or LRB255 from Liebherr can be employed as the lifting device. The lifting device grabs the end of the pipe pile and raises it upwards in the drill holes while simultaneously vibrating. The vibration of the pipe pile 16 simultaneously vibrates the concrete 18 inside the pipe pile 16, thereby compacting it. While the pipe pile 16 is being removed from between the still fluid concrete 18 and the drill hole 12, the concrete 18 spreads laterally under the force of gravity, thus filling the drill hole 12 and forming a concrete pile 22 while spreading between the interconnected drill holes 12 and forming one continuous pile wall 10. At the same time, the vibration of the pipe pile 16 compresses the still fluid concrete 18 in the drill hole 12 against the ground 100. In other words, the outer surface 23 of the concrete pile 22 forms a contact surface 25 against the ground 100. In cases where spring reinforcements are used in the pile wall, the spring reinforcements are able to deploy between the concrete piles, thus reinforcing the overall pile wall. Alternatively, the pipe piles can also be raised with no vibration; however, vibration is advantageous in terms of the implementation of the invention since it simultaneously compacts the concrete.

The upper limit L for the raising of the pipe piles 16, shown in FIG. 15*e*, is a maximum of 3 m above the upper surface of the ground 100, beyond which the pipe piles 16 must not be lifted since the movement of the water masses could otherwise slowly erode the ground around the pipe piles and eventually leave the concrete piles exposed to the water. A steel pipe pile readily withstands the long-term stress and loads caused by the water.

When the pipe piles 16 have been raised at least partially out of the portion of the drill hole 12 in the ground 100, the portion of the pipe pile 16 that extends beyond the top end of the concrete pile 22 can be cut off, as illustrated in FIG. 15*f*, and used, for example, in another object on its own or by joining two sections together. Optionally, this part can also be left intact. A harbour structure 116, for example a beam 114, to which the fenders of harbour ships can be attached, can be easily attached to the steel structure of the pipe pile 16 at the upper end of the pipe pile 16. A remaining area on a side of the pile wall 10 under construction can be filled with backfill if the structure under construction does not fill that area. The excess portion of the pipe piles can only be cut off after filling of the backfill to avoid that backfill ends up in the body of water. If the method according to the invention is carried out from the backfill, as illustrated in FIG. 15*g*, the backfill 116 remaining on the side of the pile wall 10 facing the body of water 111 is lifted out of the water body after the completion of the pile wall 10 in order to provide a sufficient water depth.

According to one embodiment, the pipe piles can also be driven back towards the drill hole after being raised, whereby the pipe pile is pushed deeper into the ground than the concrete pile.

In an aspect that does not form part of the invention, it is conceivable that the idea of the method and pile wall according to the invention can also be implemented without the reinforcements arranged inside at least one drilling pile.

It will be understood that the above description of the present invention is susceptible to various modifications, changes and adaptations, and that the same are intended to be comprehended within the meaning and range of equivalents of the appended claims.

The invention claimed is:

1. A method for forming a unified watertight pile wall in ground using a drilling device with a reamer and flushing with a medium to remove drilling waste during drilling, and non-rotating pipe piles each equipped with interlocks extending outside a diameter of the reamer and including a long interlocking member having a first length and a short interlocking member having a second length shorter than the first length, the method comprising steps of:

drilling a first vertical drill hole in the ground using the drilling device while simultaneously using the drilling device to pull or push a first one of the non-rotating pipe piles into the first vertical drill hole;

drilling at least one subsequent vertical drill hole in the ground adjacent the first vertical drill hole using the drilling device while simultaneously using the drilling device to pull or push a subsequent one of the non-rotating pipe piles into the at least one subsequent vertical drill hole, wherein the long interlocking member of the subsequent pipe pile interlocks with the short interlocking member of the first pipe pile to guide the subsequent pipe pile into the at least one subsequent vertical drill hole;

installing reinforcements in each of the vertical drill holes;

casting concrete into each of the pipe piles installed in a respective one of the vertical drill holes to form respective concrete piles; and lifting the pipe piles at least partly out of some of the adjacent vertical drill holes after the concrete has been cast, but before a transition of the concrete from a fluid concrete paste to a rigid concrete to expand the concrete of each concrete pile laterally to adjacent vertical drill holes to form the unified watertight pile wall;

wherein installing the reinforcements comprises using vertical reinforcements and spring reinforcements to reinforce the pile wall, including arranging the spring reinforcements to be joined to the vertical reinforcements and compressed in a closed position inside the respective pipe pile, and to spread essentially in a transverse direction of the pipe piles in a longitudinal direction of the pile wall when the pipe piles are lifted out of the vertical drill holes.

2. The method according to claim 1, wherein the flushing includes flushing the pipe piles using water as a medium to lead drilling water out of the respective vertical drillhole on an outside of the pipe pile.

3. The method according to claim 1, wherein the drilling includes drilling at least some of the vertical drill holes in non-cohesive soil, bedrock, or a stable layer of ground, to anchor the pile wall in place.

4. The method according to claim 1, further including forming the pile wall with 2-100 pipe piles in a casting sequence, before the lifting of the pipe piles.

5. The method according to claim 1, further including welding brackets to each pipe pile at an end travelling first into the vertical drill hole before placing the pipe pile into the ground, the welding including welding the brackets to the pipe pile on a side of the pipe pile facing an intersection with the adjacent vertical drill hole, so that each bracket welded on one side of the respective pipe pile aids to support and hold the pipe pile straight in the vertical drill hole during drilling.

6. The method according to claim 1, wherein one of the long interlocking member and the short interlocking member of one of the pipe piles is a male interlocking member and an adjacent pipe pile to the one pipe pile has the other of the long interlocking member and the short interlocking member that has a female groove positioned and dimensioned to receive and be partly loose relative to the male interlocking member of the one pipe pile to leave an open space in the female groove of the adjacent pipe pile for injecting concrete into the vertical drill hole simultaneously as each pipe pile is lifted with vibration out of the vertical drill hole.

7. The method according to claim 1, further including installing, after lifting of the pipe piles, a transverse support structure between the concrete piles to reinforce the pile wall.

8. The method according to claim 1, further including welding at least one plough protrusion next to one of the interlocks at an end of the pipe pile travelling first into the vertical drill hole, before the pipe pile is drilled into the ground, wherein the at least one plough protrusion is on a continuous sector of the pipe pile and protrudes from the pipe pile by at most a same extent as the reamer for displacing ground when lifting the pipe pile, to assist in joining the concrete piles.

9. The method according to claim 1, wherein the lifting includes lifting the pipe piles out of the drill holes by vibration while simultaneously compacting the concrete of the concrete piles.

10. The method according to claim 1, further including forming a transverse support beam on the pile wall which is exposed on a construction side of the pile wall.

11. A method for forming a unified watertight pile wall in ground using a drilling device with a reamer and flushing with a medium to remove drilling waste during drilling, and non-rotating pipe piles each equipped with interlocks extending outside a diameter of the reamer and including a long interlocking member having a first length and a short interlocking member having a second length shorter than the first length, the method comprising steps of:

drilling a first vertical drill hole in the ground using the drilling device while simultaneously using the drilling device to draw a first one of the non-rotating pipe piles into the first vertical drill hole:

drilling at least one subsequent vertical drill hole in the ground adjacent the first vertical drill hole using the drilling device while simultaneously using the drilling device to draw a subsequent one of the non-rotating pipe piles into the at least one subsequent vertical drill bole, wherein the long interlocking member of the subsequent pipe pile interlocks with the short interlocking member of the first pipe pile to guide the subsequent pip pile into the at least one subsequent vertical drill hole;

installing reinforcements in each of the vertical drill holes;

casting concrete into each of the pipe piles installed in a respective one of the vertical drill holes to form respective concrete piles;

lifting the pipe piles at least partly out of some of the adjacent vertical drill boles after the concrete has been cast, but before a transition of the concrete from a fluid concrete paste to a rigid concrete to expand the concrete of each concrete pile laterally to adjacent vertical drill holes to form the unified watertight pile wall;

wherein the drilling includes drilling at least some of the vertical holes only down to a surface of a bedrock;

placing in the reinforcements at least one hollow reinforcement inside of which is a reserve pipe;

leaving the reserve pipe empty during concrete casting;

after lifting of the pipe piles and hardening of the concrete pile, drilling a locking hole in the bedrock through the reserve pipe; and setting a rock bolt in the reserve pipe to lock the pile wall to the bedrock.

12. A method for forming a unified watertight pile wall in ground using a drilling device with a reamer and flushing with a medium to remove drilling waste during drilling, and non-rotating pipe piles each equipped with interlocks extending outside a diameter of the reamer and including a long interlocking member having a first length and a short interlocking member having a second length shorter than the first length, the method comprising steps of:

drilling a first vertical drill hole in the ground using the driling device while simultaneously using the drilling device to draw a first one of the non-rotating pipe piles into the first vertical drill hole;

drilling at least one subsequent vertical drill hole in the ground adjacent the first vertical drill hole using the drilling device while simultaneously using the drilling device to draw a subsequent one of the non-rotating pipe piles into the at least one subsequent vertical drill hole, wherein the long interlocking member of the subsequent pipe pile interlocks with the short interlocking member of the first pipe pile to guide the subsequent pipe pile into the at least one subsequent vertical drill hole;

installing reinforcements in each of the vertical drill holes;

casting concrete into each of the pipe piles installed in a respective one vertical drill holes to form respective concrete piles; and lifting the pipe piles at least partly out of some of the adjacent vertical drill holes after the concrete has been cast, but before a transition of the concrete from a fluid concrete paste to a rigid concrete to expand the concrete of each concrete pilelaterally to adjacent vertical drill holes to form the unified watertight pile wall that extends in contact with a body of water in a form of a harbour structure;

wherein the lifting the pipe piles comprises raising at least a part of the pipe piles at least partially out of a respective one of the vertical drill holes by at least part of a length of the vertical drill hole in an area of the ground of a floor of the body of water after casting of the concrete but before the transition of the cast concrete from the fluid concrete paste to the rigid concrete, wherein the pipe piles remain as a part of the pile wall above the ground of the body of water.

13. The method according to claim 12, and further including cutting off a part of each raised pipe pile that extends beyond the concrete pile.

14. The method according to claim 12, wherein the lifting includes lifting the pipe piles by at least 1 m to allow the concrete to spread and at most by a length such that the pipe pile remains in the ground in the drill hole to protect the concrete pile from open water.

15. A method for forming a unified watertight pile wall in ground using drilling device with a reamer and flushing with a medium to remove drilling waste during drilling, and non-rotating pipe piles each equipped with interlocks extending outside a diameter of the reamer and including a long interlocking member having a first length and a short interlocking member having a second length shorter than the first length, the method comprising steps of:

drilling a first vertical drill hole in the ground using the drilling device while simultaneously using the drilling device to draw a first one of the non-rotating pipe piles into the first vertical drill hole;

drilling at least one subsequent vertical drill hole in the ground adjacent the first vertical drill hole using the drilling device while simultaneously using the drilling device to draw a subsequent one of the non-rotating pipe piles into the at least one subsequent vertical drill hole, wherein the long interlocking member of the subsequent pipe pile interlocks with the short interlocking member of the first pipe pile to guide the subsequent pipe pile into the at least one subsequent vertical drill hole;

installing reinforcements in each of the vertical drill holes;

casting concrete into each of the pipe piles installed in a respective one of the vertical drill holes to form respective concrete piles;

lifting the pipe piles at least partly out of some of the adjacent vertical drill holes after the concrete has been cast, but before a transition of the concrete from a fluid concrete paste to a rigid concrete to expand the concrete of each concrete pile laterally to adjacent vertical drill holes to form the unified watertight pile wall;

installing the pipe pile in a sensitive area using compressed air inside the pipe pile for flushing up the drilled material mainly inside the pipe pile; and during drilling with compressed air, pumping water simultaneously to the drill hole in an area of a lower end of the pipe pile through a channel located outside the pipe pile to limit dropping of groundwater levels in the vertical drill hole.

16. A unified pile wall, comprising:

parallel concrete piles extending only down to an upper surface of a bedrock as a stable, uncompressed layer of drilled ground, each concrete pile including:

an essentially circularly shaped cross-section;

an outer surface;

vertical reinforcements set inside the concrete pile;

transverse reinforcements binding the vertical reinforcements in the concrete piles to each other;

wherein the concrete piles are connected in a row at a constant distance from each other by a fully integrated concrete structure comprising a sector of 1°-50° of a cross-section of each concrete pile at a whole depth of each concrete pile to form the unified pile wall having a contact surface formed on the outer surface of the concrete piles, the unified pile wall being integrated with the bedrock;

further comprising a reserve pipe fitted inside a vertical reinforcement of at least one of the concrete piles; and a rock bolt fitted through the reserve pipe into a locking hole drilled into the rock through the reserve pipe to lock the concrete piles into the bedrock horizontally.

17. A unified pile wall, comprising:

parallel concrete piles, each concrete pile including an essentially circularly shaped cross-section;

an outer surface;

vertical reinforcements set inside the concrete pile; and transverse reinforcements binding the vertical reinforcements in the concrete piles to each other;

wherein the concrete piles are connected in a row at a constant distance from each other by a fully integrated concrete structure comprising a sector of 1°-50° of a cross-section of each concrete pile at a whole depth of each concrete pile to form the unified pile wall having a contact surface formed on the outer surface of the concrete piles, the unified pile wall being integrated with a stable, uncompressed layer of drilled ground; and wherein the transverse reinforcements are spring reinforcements joined to the vertical reinforcements, the transverse reinforcements being configured to be compressed inside a pipe pile and to spread in essentially a transverse direction of the pipe piles and in a longitudinal direction of the unified pile wall prior to the concrete of the concrete piles hardening to reinforce the unified pile wall when lifting the pipe pile.

* * * * *